US008113616B2

(12) United States Patent
Hirota

(10) Patent No.: US 8,113,616 B2
(45) Date of Patent: Feb. 14, 2012

(54) LIQUID EJECTING APPARATUS

(75) Inventor: Atsushi Hirota, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 403 days.

(21) Appl. No.: 12/534,071

(22) Filed: Jul. 31, 2009

(65) Prior Publication Data

US 2010/0066784 A1 Mar. 18, 2010

(30) Foreign Application Priority Data

Sep. 18, 2008 (JP) ..... 2008-239383

(51) Int. Cl.
*B41J 29/38* (2006.01)

(52) U.S. Cl. ..... 347/17; 347/14; 347/60

(58) Field of Classification Search ..... 347/17, 347/14, 60

See application file for complete search history.

(56) References Cited

U.S. PATENT DOCUMENTS

| | | | | |
|---|---|---|---|---|
| 5,877,785 | A | 3/1999 | Iwasaki et al. | |
| 2006/0221112 | A1 | 10/2006 | Ito | |
| 2008/0043053 | A1* | 2/2008 | Suzuki | 347/17 |

FOREIGN PATENT DOCUMENTS

| | | | |
|---|---|---|---|
| JP | H07-125216 | A | 5/1995 |
| JP | 2006-272909 | A | 10/2006 |
| JP | 2006-334967 | A | 12/2006 |
| JP | 2008-143023 | A | 6/2008 |

OTHER PUBLICATIONS

Japan Patent Office, Notification of Reason for Refusal for Japanese Patent Application No. 2008-239383 (counterpart to above-captioned patent application), mailed Aug. 17, 2010.

* cited by examiner

*Primary Examiner* — Julian Huffman
(74) *Attorney, Agent, or Firm* — Baker Botts L.L.P.

(57) ABSTRACT

A liquid ejecting apparatus, including: a liquid ejecting head having a plurality of liquid-ejection openings, a liquid channel, and a plurality of actuators; an inflow liquid temperature sensor which detects a temperature of a liquid to be flowed into the liquid channel from an outside; a driver IC which is disposed so as to be thermally connected to the liquid ejecting head, which includes a signal producing circuit configured to produce an ejection signal, a non-ejection signal, and a vibration signal; and a controller including: a storing section configured to store drive data of the plurality of actuators; a first estimating section configured to estimate a first heat amount; a second estimating section configured to estimate a second heat amount; and a signal-producing-circuit controlling section configured to cause the signal producing circuit to produce the ejection signal, the non-ejection signal, and the vibration signal, wherein the signal-producing-circuit controlling section controls the signal producing circuit such that an increased heat amount exceeds a third heat amount.

24 Claims, 10 Drawing Sheets

LIQUID EJECTING APPARATUS

CROSS REFERENCE TO RELATED APPLICATION

The present application claims priority from Japanese Patent Application No. 2008-239383, which was filed on Sep. 18, 2008, the disclosure of which is herein incorporated by reference in its entirety.

BACKGROUND OF THE INVENTION

1. Field of the Invention

The present invention relates to a liquid ejecting apparatus including a liquid ejecting head configured to eject liquid droplets.

2. Description of the Related Art

Patent Document 1 (US 2006/0221112 A1 corresponding to JP-A-2006-272909) discloses an ink-jet recording apparatus including an ink-jet head having a channel unit, and an actuator unit and a driver IC fixed on an upper surface of the channel unit. In this ink-jet recording apparatus, when a temperature sensor included in the driver IC detects a temperature lower than a predetermined temperature, the controller controls the driver IC to supply a non-ejection signal to the actuator unit. In this time, heat of the driver IC is transferred to the actuator unit via the channel unit. Thus, an environmental temperature of the actuator unit is risen by a multiplier effect of heat generated by the actuator unit and heat from the driver IC. As a result, there can be restrained a deterioration of a recording quality owing to a change of a displacement amount of an active portion of the actuator unit, which change is caused by the environmental temperature.

SUMMARY OF THE INVENTION

In the ink-jet recording apparatus described in the Patent Document 1, a control is performed in which mainly the environmental temperature of the actuator unit is kept at a value equal to or higher than a predetermined value, but a control is not performed in which the diver IC is driven to generate heat where a low-temperature ink is flowed into the ink-jet head. Thus, the low-temperature ink flowed into the head lowers an ink temperature in the head, thereby increasing an ink viscosity. This increase in the ink viscosity may pose a risk in which the ink cannot be ejected from nozzles or ejected with a relatively small amount because a resistance to a flow of the ink becomes relatively large.

On the other hand, where ejection energy applied to the ink is increased in order to eject the ink, whose viscosity is increased, from the nozzles with the same amount as at ordinary temperatures, electric power consumption upon the ink ejection becomes large. Further, it is possible to restrain the increase in the ink viscosity in the head by also providing a heater on the ink-jet head, but in this case, a manufacturing cost unfortunately increases.

This invention has been developed in view of the above-described situations, and it is an object of the present invention to provide a liquid ejecting apparatus which can heat a liquid in a liquid channel of a liquid ejecting head and a liquid to be flowed into the liquid channel by heat generated by a driver IC and thereby lower a liquid viscosity.

The object indicated above may be achieved according to the present invention which provides a liquid ejecting apparatus, comprising: A liquid ejecting apparatus, comprising: a liquid ejecting head including (a) a plurality of liquid-ejection openings from each of which a liquid droplet is ejected, (b) a liquid channel having a plurality of individual liquid channels each having one end as a corresponding one of the plurality of liquid-ejection openings, and (c) a plurality of actuators each of which applies, to a liquid in a corresponding one of the plurality of individual liquid channels, ejection energy that causes the liquid droplet to be ejected from a corresponding one of the plurality of liquid-ejection openings; an inflow liquid temperature sensor which detects a temperature of the liquid to be flowed into the liquid channel from an outside; a driver IC which is disposed so as to be thermally connected to the liquid ejecting head, which includes a signal producing circuit configured to produce (a) an ejection signal that causes the liquid droplet to be ejected from the liquid-ejection opening, (b) a non-ejection signal that causes the liquid droplet not to be ejected from the liquid-ejection opening and a liquid near the liquid-ejection opening not to be vibrated, and (c) a vibration signal that causes the liquid droplet not to be ejected from the liquid-ejection opening and the liquid near the liquid-ejection opening to be vibrated, and which supplies one of the produced signals to each of the plurality of actuators in each recording period; and a controller configured to control the driver IC, wherein the controller includes: a storing section configured to store drive data of the plurality of actuators that indicate an amount of the liquid droplets ejected from the plurality of liquid-ejection openings in each recording period; a first estimating section configured to estimate a first heat amount by which the liquid to be flowed into the liquid channel in a predetermined period including a plurality of the recording periods deprives the liquid ejecting head of heat on the basis of (a) an amount of the liquid to be flowed into the liquid channel by the ejection of the liquid droplets from the plurality of liquid-ejection openings on the basis of the stored drive data, (b) an internal channel liquid temperature as a temperature of the liquid in the liquid channel, and (c) an inflow liquid temperature detected by the inflow liquid temperature sensor; a second estimating section configured to estimate, on the basis of the stored drive data, a second heat amount generated by the driver IC in the predetermined period by supplying the ejection signal to the plurality of actuators by the signal producing circuit; and a signal-producing-circuit controlling section configured to cause the signal producing circuit to produce the ejection signal, the non-ejection signal, and the vibration signal in each recording period on the basis of the stored drive data such that one of the ejection signal, the non-ejection signal, and the vibration signal is supplied to each of the plurality of actuators, and wherein the signal-producing-circuit controlling section controls the signal producing circuit such that an increased heat amount exceeds a third heat amount obtained by subtracting the second heat amount from the first heat amount, the increased heat amount being as a heat amount of the driver IC which is increased by supplying, instead of the non-ejection signal supplied to each of at least one of the plurality of actuators, the vibration signal to each of at least one of the at least one actuator to which the non-ejection signal is supplied.

In the liquid ejecting apparatus as described above, since the signal-producing-circuit controlling section controls the signal producing circuit such that the driver IC generates the heat amount exceeding the third heat amount, the liquid in the liquid channel and the liquid flowed from the outside into the liquid channel are heated by the heat amount generated by the driver IC, thereby restraining an increase in thickening of a viscosity of the liquid.

BRIEF DESCRIPTION OF THE DRAWINGS

The objects, features, advantages, and technical and industrial significance of the present invention will be better understood by reading the following detailed description of a preferred embodiment of the invention, when considered in connection with the accompanying drawings, in which.

DESCRIPTION OF THE PREFERRED EMBODIMENT

Hereinafter, there will be described a preferred embodiment of the present invention by reference to the drawings.

Figure 1:
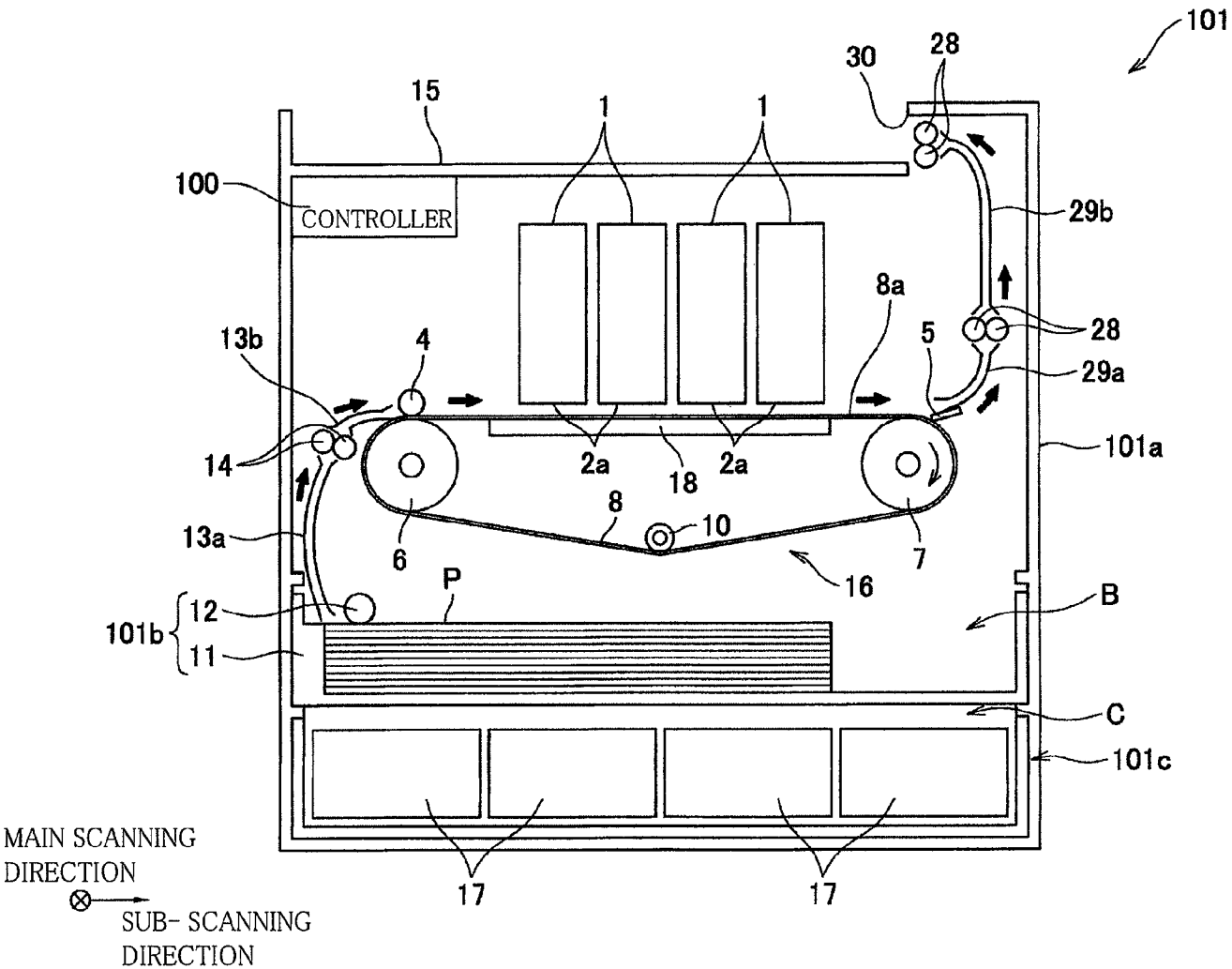
FIG. 1 is a schematic view showing an internal structure of an ink-jet printer as an embodiment of the present invention.

As shown in FIG. 1, an ink-jet printer 101 includes a body 101*a* having a rectangular parallelepiped shape, and an inside of the body 101*a* is separated into three spaces A, B, C in order from above. In the space A, there are disposed four ink-jet heads (i.e., liquid-droplets ejecting heads) 1 which respectively eject inks of four colors, namely, magenta, cyan, yellow, and black, and a sheet-feed mechanism 16. A top portion of the body 101*a* which partly defines the space A is provided by a sheet-discharge portion 15. In the space B is disposed a sheet-supply unit 101*b* attachable to and detachable from the body 101*a* while in the space C is disposed an ink-tank unit 101*c* attachable to and detachable from the body 101*a*. Further, in the body 101*a*, there is provided a controller 100 configured to control operations of the ink-jet heads 1 and the sheet-feed mechanism 16.

In the ink-jet printer 101, there is formed a sheet feeding path in which each sheet P is fed from the sheet-supply unit 101*b* toward the sheet-discharge portion 15 along boldface arrow in FIG. 1. The sheet-supply unit 101*b* includes a sheet-supply tray 11 and a sheet-supply roller 12. The sheet-supply tray 11 has a box-like shape opening upward and accommodates a plurality of the sheets P in a state in which the sheets P are stacked on each other. The sheet-supply roller 12 supplies an uppermost one of the sheets P accommodated in the sheet-supply tray 11. The supplied sheet P is fed to the sheet-feed mechanism 16 while being guided by guides 13*a*, 13*b* and nipped by and between a pair of feed rollers 14.

As shown in FIG. 1, the sheet-feed mechanism 16 includes two belt rollers 6, 7, a sheet-feed belt 8, a tension roller 10, and a platen 18. The sheet-feed belt 8 is an endless belt wound around the rollers 6, 7 so as to bridge the rollers 6, 7. The tension roller 10 applies tension to the sheet-feed belt 8 by being biased downward while contacting with an inner peripheral surface of the sheet-feed belt 8 at a lower portion thereof. The platen 18 is disposed in an area enclosed by the sheet-feed belt 8. Further, the platen 18 supports the sheet-feed belt 8 at a position opposed to the ink-jet heads 1 such that the sheet-feed belt 8 is not bent or warped downward. The belt roller 7 is a drive roller which is rotated in a clockwise direction in FIG. 1 by being given a drive force to a shaft of the belt roller 7 from a sheet-feed motor 19. The belt roller 6 is a driven roller which is rotated in the clockwise direction in FIG. 1 by rotation of the sheet-feed belt 8 which is caused by rotation of the belt roller 7.

An outer peripheral surface 8*a* of the sheet-feed belt 8 is subjected to a silicone treatment to have a viscosity. At a position opposed to the belt roller 6 is disposed a nipping roller 4. The nipping roller 4 presses, to the outer peripheral surface 8*a* of the sheet-feed belt 8, each sheet P supplied by the sheet-supply unit 101*b*. The sheet P pressed to the outer peripheral surface 8*a* is fed in a sheet feeding direction (i.e., a rightward direction in FIG. 1 or a sub-scanning direction) while being held by and on the outer peripheral surface 8*a* owing to the viscosity thereof. It is noted that, in the present embodiment, the sub-scanning direction is a direction parallel to the sheet feeding direction in which each sheet P is fed by the sheet-feed mechanism 16 while a main scanning direction is a direction perpendicular to the sub-scanning direction and along a horizontal surface.

A peeling plate 5 is provided at a position opposed to the belt roller 7. The peeling plate 5 peels each sheet P from the outer peripheral surface 8*a*. The peeled sheet P is fed while being guided by guides 29*a*, 29*b* and being nipped between two pairs of feed rollers 28. Then, the sheet P is discharged to the sheet-discharge portion 15 from an opening 30 formed in an upper portion of the body 101*a*.

The four ink-jet heads 1 are respectively corresponded to the inks of four colors, namely, magenta, cyan, yellow, and black, and each of the ink-jet heads 1 has a generally rectangular parallelepiped shape extending in the main scanning direction. Further, the four ink-jet heads 1 are fixed so as to be arranged in the sheet feeding direction. That is, the ink-jet printer 101 is a printer of a line type.

A bottom surface of each of the ink-jet heads 1 is provided by an ink-ejection surface 2*a* in which a plurality of ink-ejection openings 108 (with reference to FIGS. 6 and 7) are formed. Through the plurality of ink-ejection openings 108, the ink is ejected. When each sheet P is fed through just below the four ink-jet heads 1, the inks of the respective colors are sequentially ejected to an upper surface of the sheet P from the ink-ejection openings 108. As a result, a desired color image is formed on the upper surface of the sheet P, i.e., a recording surface.

The ink-jet heads 1 are respectively connected to ink tanks (liquid storing portions) 17 in the ink-tank unit 101*c*. That is, each of the inks of the four colors is stored in a corresponding one of the four ink tanks 17 and is supplied from the corresponding ink tank 17 via a corresponding one of tubes (i.e., connecting tubes) 3 (with reference to FIG. 2) to an ink channel (a liquid channel) in the corresponding ink-jet head 1.

Figure 2:
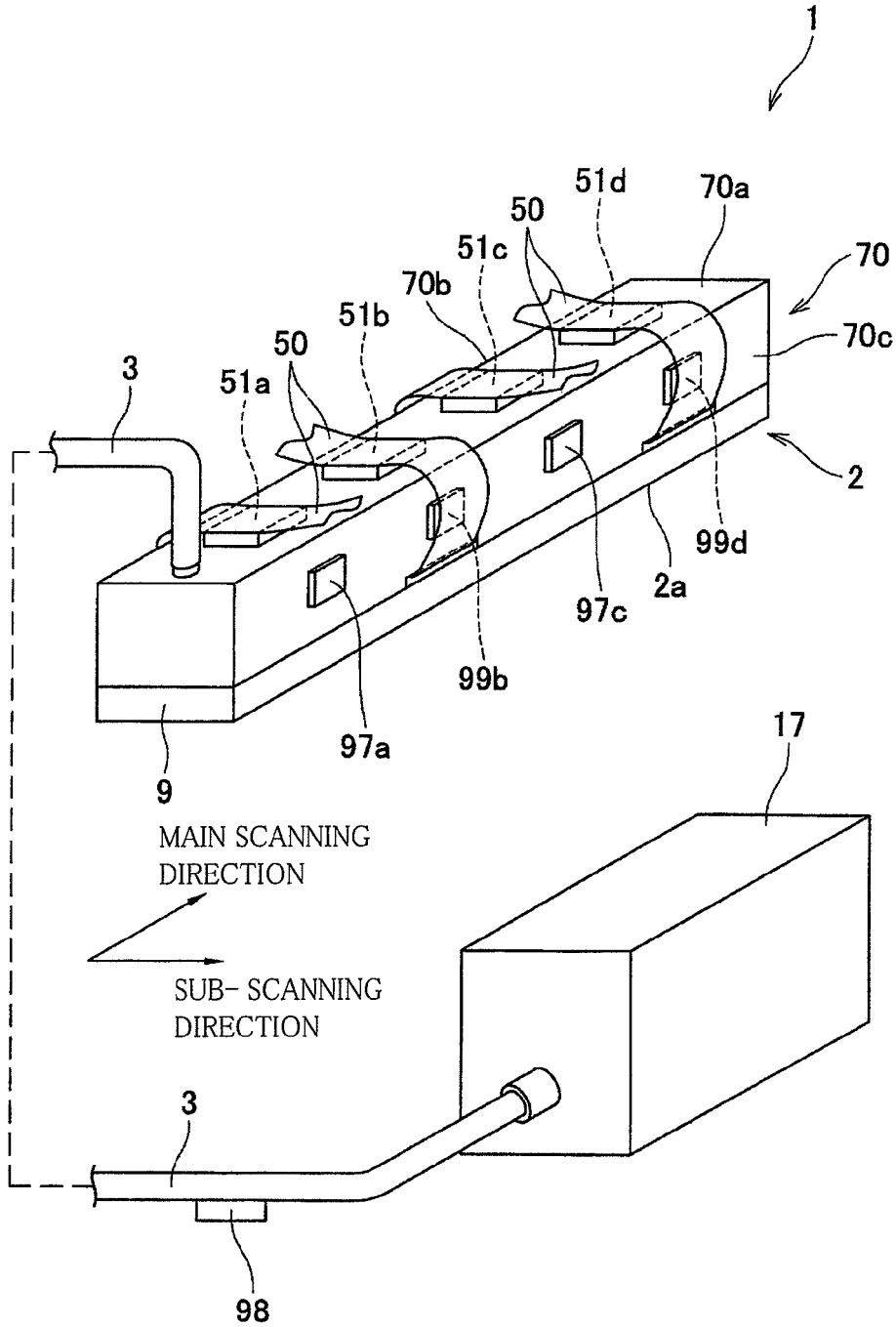
FIG. 2 is a generally perspective view showing one of ink-jet heads and one of ink tanks shown in FIG. 1.
Figure 3:
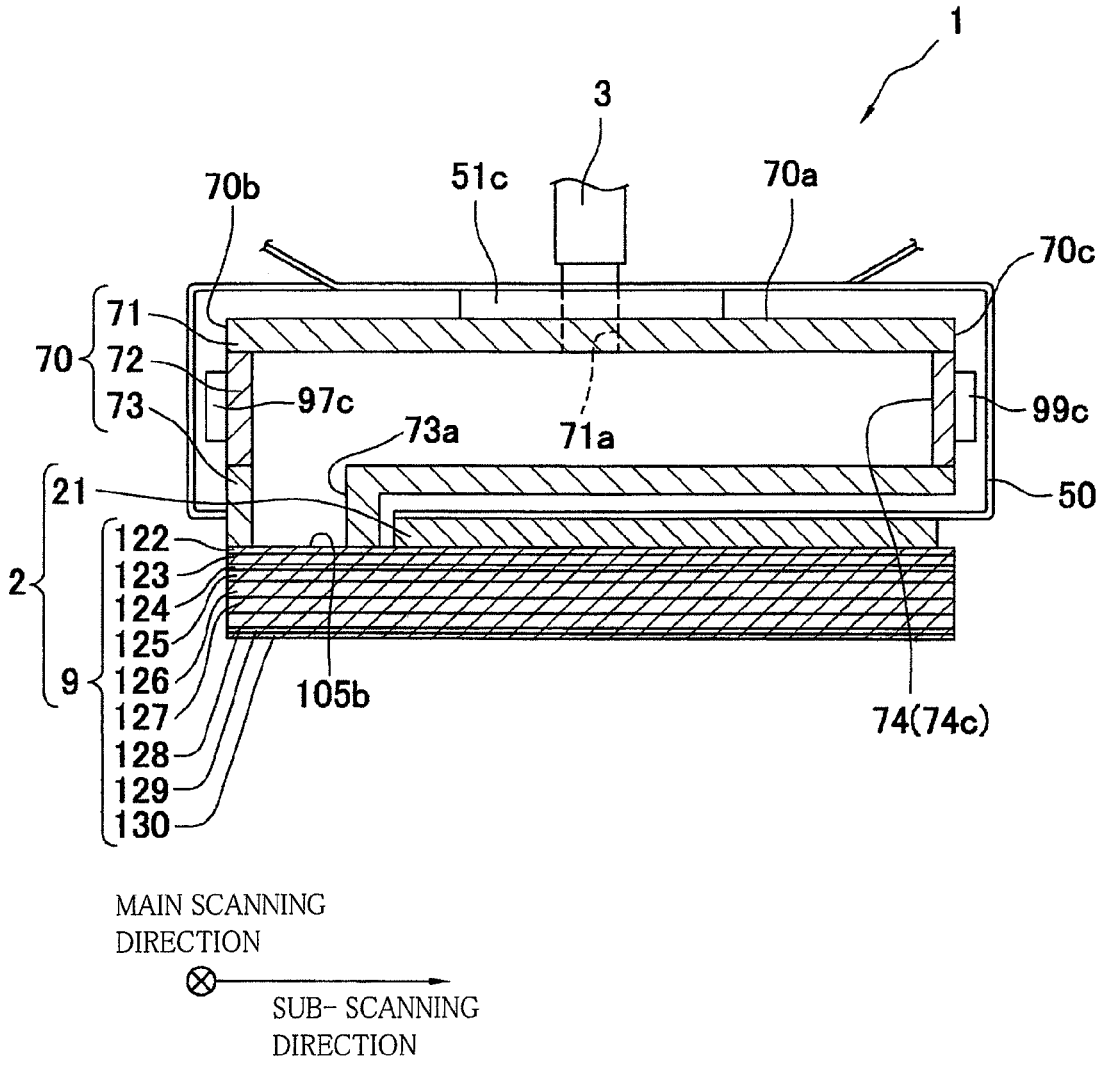
FIG. 3 is a cross-sectional view of the ink-jet head shown in FIG. 2.
Figure 4:
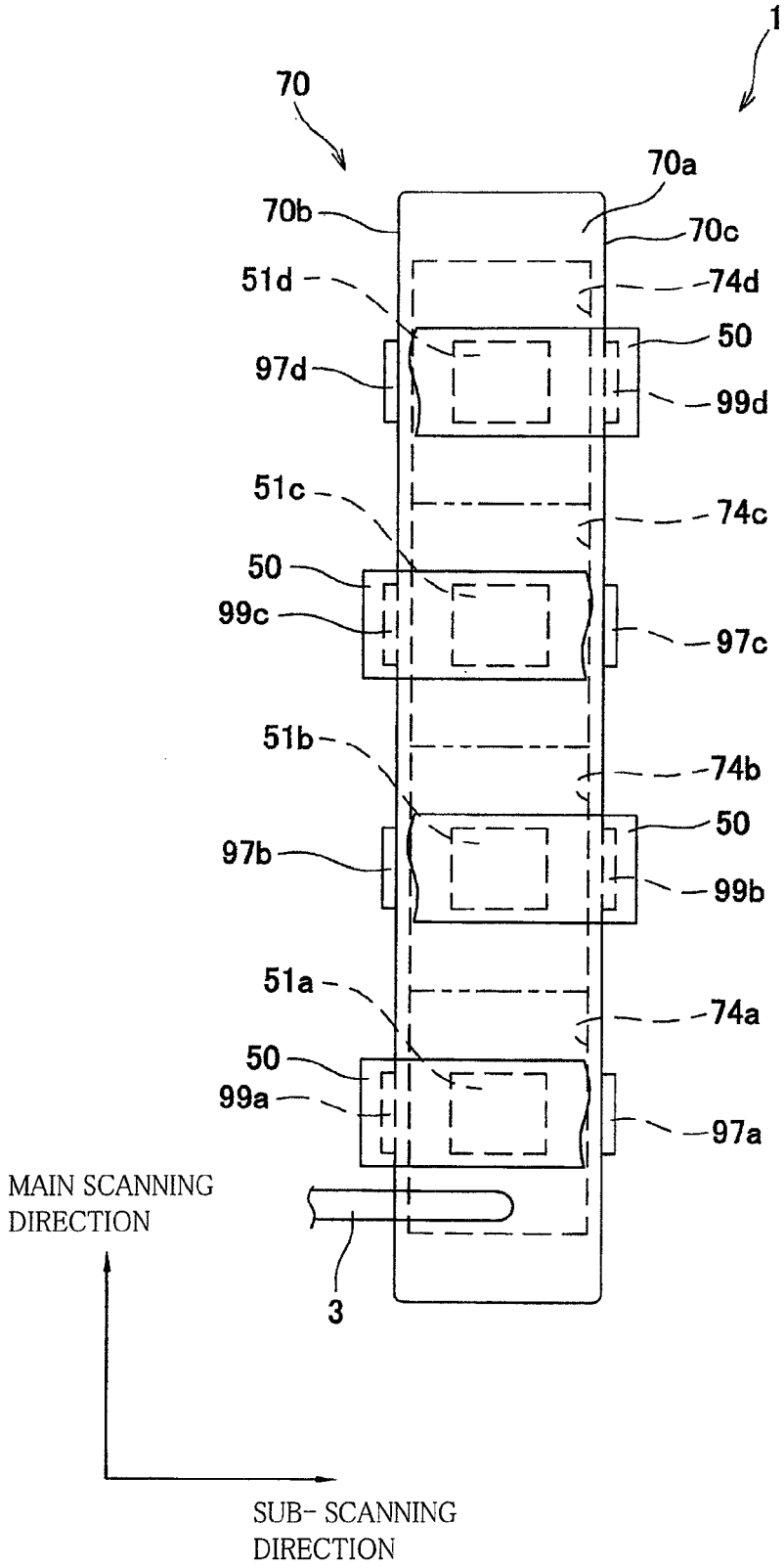
FIG. 4 is a plan view of the ink-jet head shown in FIG. 2.

There will be next explained the ink-jet heads 1 in detail with reference to FIGS. 2-4. As shown in FIGS. 2 and 3, each of the ink-jet heads 1 includes a head main body (a second channel member) 2 and a reservoir unit (a first channel member) 70 fixed to an upper surface of the head main body 2. It is noted that the four ink-jet heads 1 have the same construction and thus there will be explained one of the ink-jet heads 1.

As shown in FIG. 3, the reservoir unit 70 includes three metal plates 71-73 each of which has a rectangular planar shape and which are stacked on each other. Thus, the reservoir unit 70 has a generally rectangular parallelepiped shape in the main scanning direction. Further, in the reservoir unit 70, there are formed an ink-inlet channel 71*a*, a reservoir channel 74, and eight ink-outlet channels 73*a* each of which partly constitutes the ink channel of the head 1 and which are communicated with each other. It is noted that FIG. 3 shows only one of the ink-outlet channels 73*a*.

To the ink-inlet channel 71*a* is connected the tube 3, so that the ink is flowed into the ink-inlet channel 71*a* via the tube 3. It is noted that a temperature sensor (an inflow liquid temperature sensor) 98 is provided on or fixed to a midway portion of the tube 3 (with reference to FIGS. 2 and 9). The temperature sensor 98 is configured to detect a temperature of the ink existing on an outside of the ink-jet head 1 (i.e., the ink to be flowed into the ink-jet head 1) to transmit, to the controller 100, a detected signal based on the detection by the temperature sensor 98. In the present embodiment, the temperature sensor 98 is disposed near an outlet of the ink tank 17 so as to be allowed to measure a temperature of the tube 3.

The reservoir channel 74 temporarily stores the ink supplied from the ink tank 17. The reservoir channel 74 (74*a*-74*d*) extends as shown in FIG. 4 in the main scanning direction or in a lengthwise direction thereof and has the largest capacity among the channels formed in the head 1.

A lower surface of the plate 73 is provided by a surface having projections and depressions such that spaces are formed between the lower surface of the plate 73 and FPCs (Flexible Printed Circuits) 50 which will be described below. The plate 73 is fixed to a channel unit 9 (which will be described below) by projected potions of the lower surface of the plate 73, and the reservoir channel 74 is communicated with ink-supply openings 105*b* (which will be described below) of the channel unit 9 by the ink-outlet channels 73*a* respectively formed in the projected portions. As a result, the ink supplied from the ink tanks 17 passes through the ink-inlet channel 71*a*, the reservoir channel 74, and the ink-outlet channels 73*a* in order and to be supplied from the ink-supply openings 105*b* to the channel unit 9.

As shown in FIG. 4, to the reservoir unit 70, there are fixed four heaters 97*a*-97*d* so as to be thermally connected to each other, more specifically, the heaters 97*b*, 97*d* are fixed to a side face 70*b* of the reservoir unit 70 while the heaters 97*a*, 97*c* are fixed to a side face 70*c* of the reservoir unit 70. As shown in FIG. 3, these four heaters 97*a*-97*d* are disposed in correspondence with the ink-outlet channels 73*a*. The heaters 97*a*-97*d* generate heat by being energized by a control of the controller 100, and thereby individually heat the ink in respective partial channels 74*a*-74*d* which are formed by dividing the reservoir channel 74 in quarters in the main scanning direction. More specifically, the heaters 97*a*-97*d* mainly heat the ink near the ink-outlet channels 73*a* of the reservoir channel 74.

Further, to the reservoir unit 70, there are fixed four temperature sensors (first temperature sensors) 99*a*-99*d*, more specifically, the temperature sensors 99*a*, 99*c* are fixed to the side face 70*b* while the temperature sensors 99*b*, 99*d* are fixed to the side face 70*c*. These four temperature sensors 99*a*-99*d* are disposed at positions respectively opposed to the heaters 97*a*-97*d* in the sub-scanning direction, and configured to individually detect respective temperatures of the ink in the partial channels 74*a*-74*d* formed by dividing the reservoir channel 74 in quarters. This allows a temperature of the ink (i.e., ink temperature) in the reservoir channel 74 to be accurately detected. The four temperature sensors 99*a*-99*d* transmit, to the controller 100, detected signals based on the detections by the respective temperature sensors 99*a*-99*d*.

As shown in FIG. 3, the head main body 2 is constituted by the channel unit 9 and four actuator units 21 which are bonded to each other by adhesives, and has a generally rectangular parallelepiped shape in the main scanning direction or in a longitudinal direction thereof. To upper surfaces of the respective actuator units 21, there are respectively fixed one ends of the FPCs 50, the FPCs 50 are drawn to an outside from openings of the respective spaces formed by depressed portions of the lower surface of the plate 73. As shown in FIGS. 2 and 4, on the four FPCs 50 are respectively mounted driver ICs 51*a*-51*d*. Each of the driver ICs 51*a*-51*d* has an outputting circuit 52 configured to produce signals (specifically, an ejection signal, a non-ejection signal, a vibration signal which will be described below) for driving the actuator units 21 and to sequentially output the produced signals to individual electrodes 135 (with reference to FIG. 8). The other ends of the respective FPCs 50 are electrically connected to the controller 100, and the controller 100 controls drivings of the actuator units 21 via the respective driver ICs 51*a*-51*d*.

As shown in FIGS. 2-4, the four driver ICs 51*a*-51*d* are fixed to an upper surface 70*a* of the reservoir unit 70 (with reference to FIG. 3). More specifically, the four driver ICs 51*a*-51*d* are thermally coupled to the plate (i.e., a defining member) 71 partly defining the reservoir channel 74. Further, the four driver ICs 51*a*-51*d* are arranged at a center of the upper surface 70*a* in the sub-scanning direction so as to be equally spaced from each other in the main scanning direction. Further, the four driver ICs 51*a*-51*d* are respectively opposed to the partial channels 74*a*-74*d* of the reservoir channel 74. As shown in FIG. 4, the four driver ICs 51*a*-51*d* are disposed respectively adjacent to the temperature sensors 99*a*-99*d* and the heaters 97*a*-97*d* in correspondence with the respective partial channels 74*a*-74*d*. In this construction, when the driver ICs 51*a*-51*d* are driven to generate heat by a control of the controller 100, the generated heat mainly heats the ink in the respective partial channels 74*a*-74*d* via the plate 71. In this time, as will be described below, the heat generated by the driver ICs 51*a*-51*d* also heats the channel unit 9 via the reservoir unit 70.

There will be next explained the head main body 2 in more detail with reference to FIGS. 5-8. It is noted that, in FIG. 6, a pressure chamber 110, an aperture 112, and the ink-ejection opening 108 are indicated by solid lines for easier understanding purposes though these elements should be indicated by broken lines because these elements are located under the actuator unit 21 (i.e., in the channel unit 9).

Figure 5:
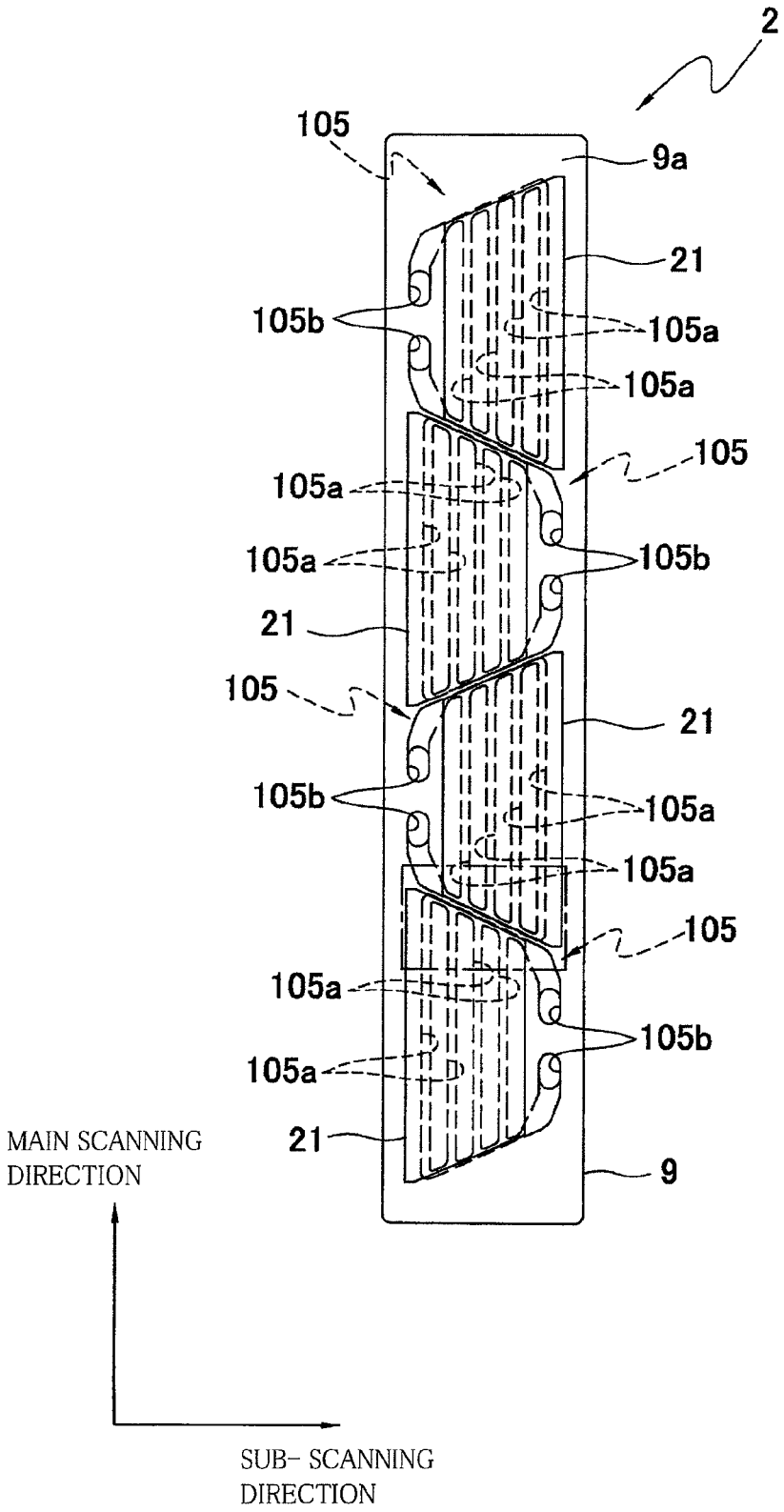
FIG. 5 is a plan view of a head main body.
Figure 7:
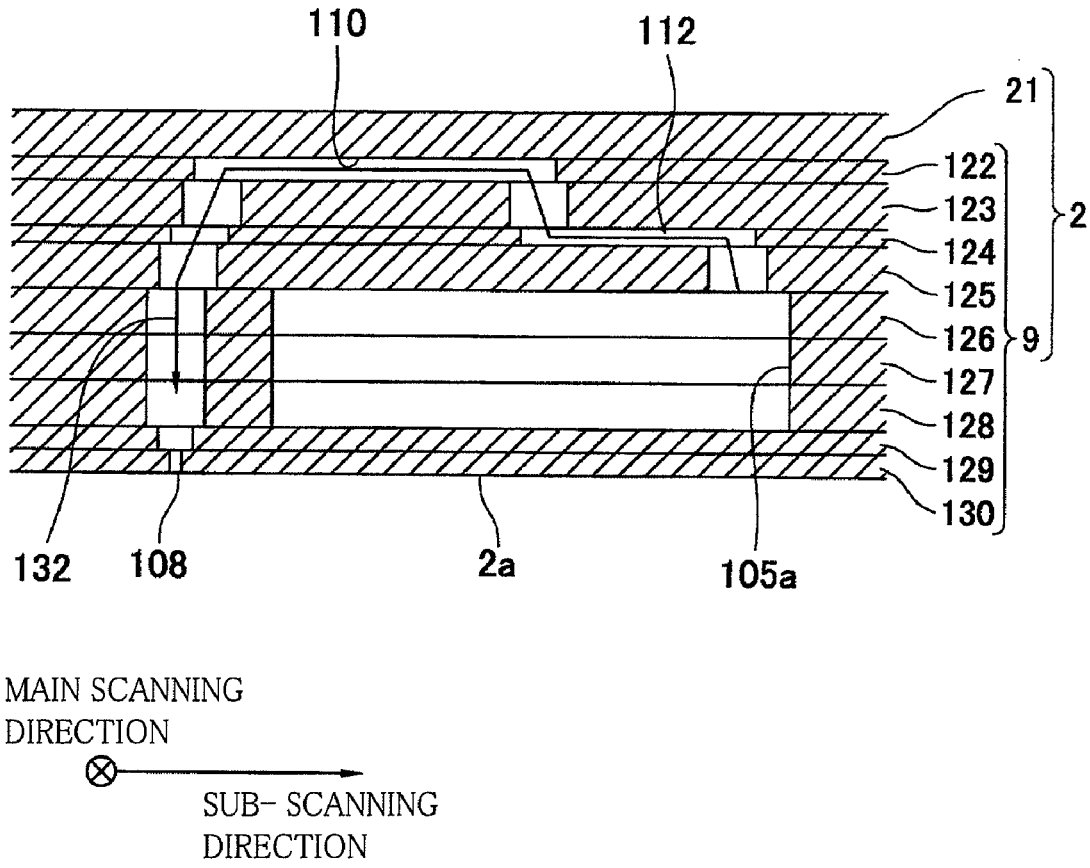
FIG. 7 is a cross-sectional view of a channel unit and an actuator unit which constitute the head main body.

As shown in FIG. 5, in the head main body 2, the four actuator units 21 are fixed to an upper surface 9*a* of the channel unit 9. As shown in FIG. 7, in the channel unit 9, there are formed ink channels including a plurality of the pressure chambers 110 and so on. The actuator units 21 include a plurality of actuators corresponding to each of the pressure chambers 110 and each has a function to selectively apply ejection energy to the ink in the pressure chambers 110 by the supply of the ejection signal from the driver ICs 51.

Figure 6:
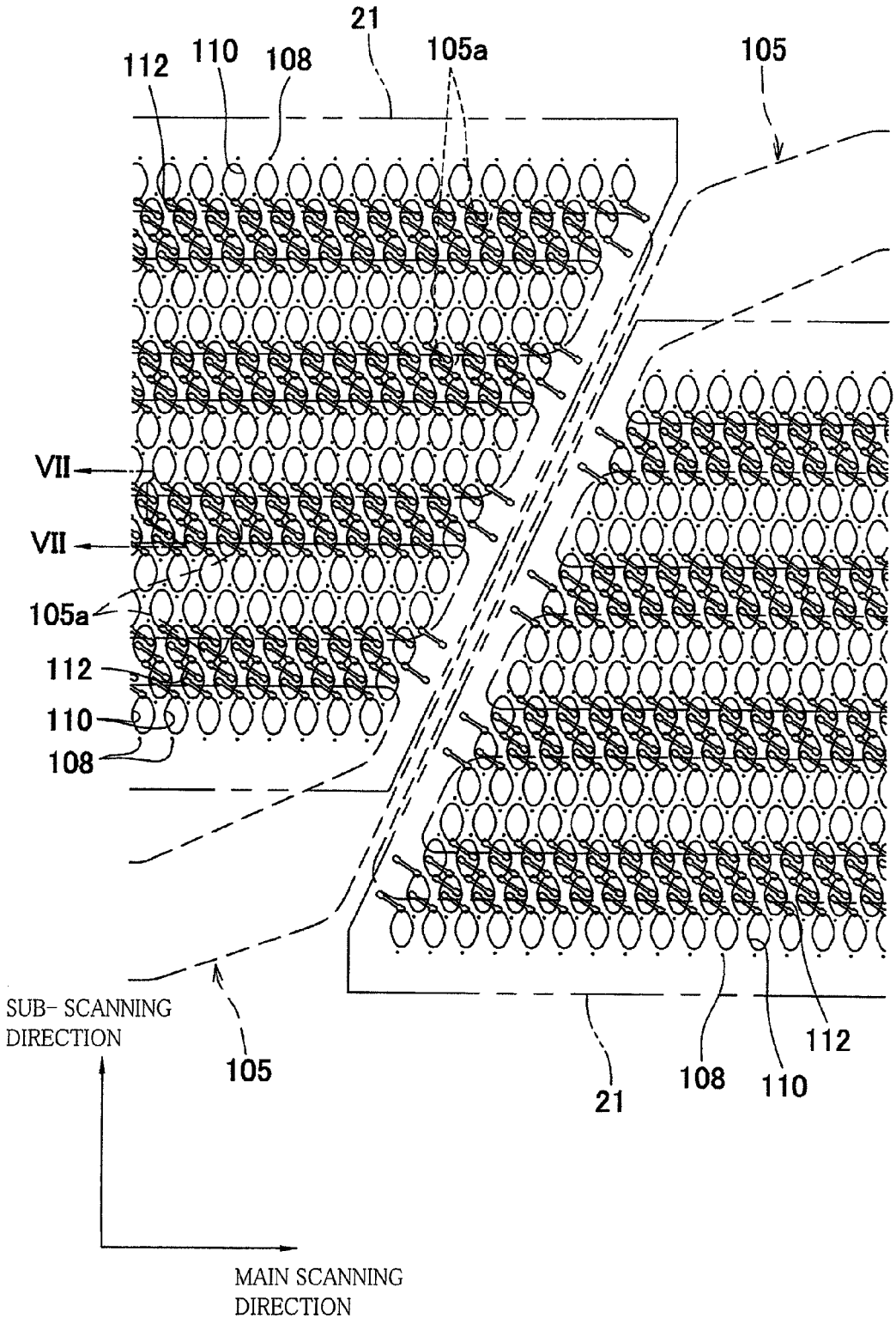
FIG. 6 is an enlarged view of an area enclosed with one-dot chain line in FIG. 5.

As shown in FIG. 5, the channel unit 9 has a rectangular parallelepiped shape extending in the main scanning direction. In the upper surface 9*a* of the channel unit 9, the eight ink-supply openings 105*b* are opened in correspondence with the ink-outlet channels 73*a* of the reservoir unit 70. These ink-supply openings 105*b* are disposed in the main scanning direction in a staggered configuration with each two of the ink-supply openings 105*b* being as a pair. As shown in FIGS. 5 and 6, in the channel unit 9, there are formed four manifold channels 105 each of which is communicated with a corresponding one of pairs of the ink-supply openings 105*b*.

The four manifold channels 105 are arranged in the main scanning direction so as to be respectively opposed to the partial channels 74*a*-74*d* in a vertical direction. To each of the manifold channels 105, the ink is flowed mainly from a corresponding opposed one of the partial channels 74*a*-74*d*. It is noted that the four manifold channels 105 are independent of each other in the channel unit 9, but are communicated with each other in the reservoir unit 70.

Further, each of the manifold channels 105 includes four sub-manifold channels 105*a* branched therefrom and extending in the main scanning direction so as to be parallel to each other. As shown in FIGS. 5 and 6, the four sub-manifold channels 105*a* are disposed respectively at positions in which an entirety of the four sub-manifold channels 105*a* is superposed on each of the actuator units 21 in the vertical direction. As thus described, the manifold channels 105 and the partial channels 74*a*-74*d* are disposed in correspondence with the actuator units 21, and the temperature sensors 99*a*-99*d* and the heaters 97*a*-97*d* are disposed in correspondence with the partial channels 74*a*-74*d*. That is, the manifold channels 105, the partial channels 74*a*-74*d*, the temperature sensors 99*a*-99*d*, and the heaters 97*a*-97*d* are provided in correspondence with a placement of the actuator units 21.

Further, the channel unit 9 has a smaller thermal capacity than the reservoir unit 70, and is thermally coupled to the four driver ICs 51*a*-51*d* via the reservoir unit 70. As a result, the heat from the driver ICs 51*a*-51*d* is diffused by the reservoir unit 70 having a relatively large thermal capacity, so that the channel unit 9 is uniformly heated from a surface thereof which is coupled to the reservoir unit 70. Thus, the channel unit 9 is less affected by a thermal fluctuation based on a placement of the driver ICs 51*a*-51*d* and a difference of an amount of generated heat when compared with a case in which the driver ICs 51*a*-51*d* are directly fixed to or thermally coupled to the channel unit 9. Further, the channel unit 9 is heated, whereby the ink in the ink channels in the channel unit 9 is also heated.

In the present embodiment, in the upper surface 9*a* of the channel unit 9, a plurality of the pressure chambers 110 are arranged in matrix in the main scanning direction so as to be equally spaced from each other, thereby constituting sixteen rows of the pressure chambers 110. These pressure-chamber rows are disposed in the sub-scanning direction so as to be parallel to each other. In correspondence with an outer shape (a trapezoid shape) of each of the actuator units 21, the number of the pressure chambers 110 included in each of the pressure-chamber rows gradually decreases from a longer side toward a shorter side of the trapezoid shape of each of the actuator units 21. The ink-ejection openings 108 are also disposed in a manner similar to this configuration in the lower surface (the ink-ejection surface 2*a*) of the channel unit 9.

As shown in FIG. 7, the channel unit 9 is constituted by nine plates 122-130 each formed of a metal material such as stainless steel. Each of these plates 122-130 includes a planar surface having a rectangular shape extending in the main scanning direction.

Through holes formed through the respective plates 122-130 are communicated with each other by stacking the plates 122-130 on each other while positioning. As a result, in the channel unit 9, there are formed a plurality of individual ink channels 132 partly constituting the ink channels of the head 1 and extending from the four manifold channels 105 (the sub-manifold channels 105*a*) and outlets of the respective sub-manifold channels 105*a* to the ink-ejection openings 108 via the pressure chambers 110.

There will be next explained a flow of the ink in the channel unit 9. The ink supplied from the reservoir unit 70 into the channel unit 9 via the ink-supply openings 105*b* is diverted into the sub-manifold channels 105*a* in each of the manifold channels 105. The ink in the sub-manifold channels 105*a* is flowed into each of the individual ink channels 132 and reaches a corresponding one of the ink-ejection openings 108 via a corresponding one of a plurality of the apertures 112 each as functioning as a restrictor and a corresponding one of the pressure chambers 110.

Figure 8:
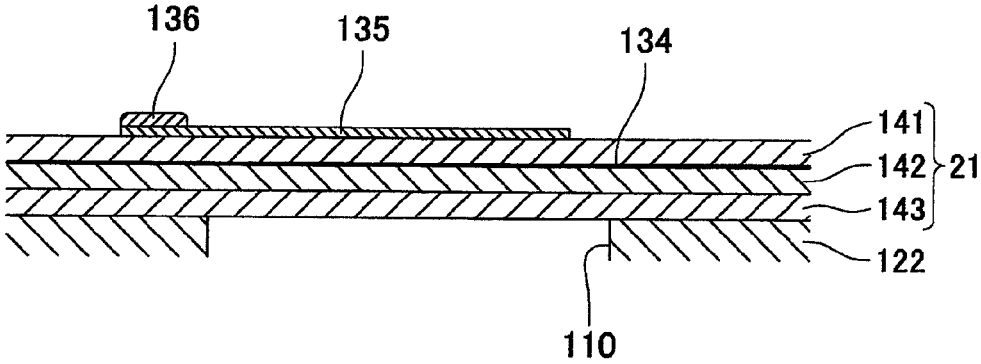
FIG. 8 is a partially cross-sectional view of the actuator unit.

There will be next explained the actuator units 21. As shown in FIG. 5, each of the actuator units 21 has a trapezoid planar shape. Further, each actuator unit 21 is formed of a ceramic material of lead zirconate titanate (PZT) having ferroelectricity, and as shown in FIG. 8, is constituted by three piezoelectric sheets 141-143. On an upper surface of the piezoelectric sheet 141, the plurality of individual electrodes 135 are formed so as to be respectively opposed to the pressure chambers 110. Each of the individual electrodes 135 includes (a) an electrode portion disposed on an area of the upper surface which is opposed to a corresponding one of the pressure chambers 110 and (b) an extended portion drawn to an outside of the area opposed to the corresponding pressure chamber 110. On the extended portion is formed a land 136. Between the piezoelectric sheet 141 and the piezoelectric sheet 142, there is provided a common electrode 134 formed so as to extend or cover an entirety of the piezoelectric sheet 142. It is noted that on the upper surface of the piezoelectric sheet 141 is formed the land 136 for the common electrode in addition to the land 136 for the individual electrode, so that the common electrode 134 is electrically connected to the land 136 for the common electrode.

Via the land 136 and inner wiring of the FPCs 50, the common electrode 134 is kept at a ground potential equally in areas thereof respectively corresponding to all the pressure chambers 110. On the other hand, the individual electrodes 135 are electrically connected to the respective outputting circuits 52 of the respective driver ICs 51*a*-51*d*, so that one of the ejection signal, the non-ejection signal, and the vibration signal from the driver ICs 51*a*-51*d* is selectively inputted to the individual electrodes 135. As thus described, in each of the actuator units 21, there are provided a plurality of the actuators corresponding to the number of the pressure chambers 110, with the individual electrodes 135 and areas interposed between the individual electrodes 135 and the pressure chambers 110 as individual actuators.

Here, there will be explained a method for driving the actuator units 21 in order to eject ink droplets from the ink-ejection openings 108. The piezoelectric sheet 141 is polarized across a thickness thereof (hereinafter, may be referred to as a "polarization direction"), and when an electric field is applied to the piezoelectric sheet 141 in the polarization direction in a state in which the individual electrodes 135 are given a potential different from that of the common electrode 134, the piezoelectric sheet 141 functions as an active portion in which a portion of the piezoelectric sheet 141 to which the electric field is applied is deformed owing to piezoelectric effect. This active portion extends in its thickness direction and contracts or shrinks in its surface direction when directions of the electric field and the polarization are the same as each other. An amount of displacement of this extension and contraction is larger in the surface direction than in the thickness direction. On the other hand, the lower piezoelectric sheets 142, 143 nearer to the pressure chambers 110 are non-active layers which are not voluntarily displaced with respect to an external electric field.

As shown in FIG. 8, the piezoelectric sheet 143 is fixed to an upper surface of the cavity plate 122 partly defining the pressure chambers 110, and thus when a difference in distortion is produced in a direction (a planar direction) perpendicular to the vertical direction between portions of the piezoelectric sheet 141 to which the electric field is applied and the underlying piezoelectric sheets 142, 143, the piezoelectric sheets 141-143 are entirely deformed into a convex shape that protrudes toward the pressure chambers 110, that is, a unimorph deformation occurs. As a result, a pressure (i.e., ink-ejection energy) is applied to the ink in the pressure chambers 110, thereby producing a pressure wave in the pressure chambers 110. Then, the produced pressure wave is propagated from the pressure chambers 110 to the ink-ejection openings 108, whereby the ink droplets are ejected from the ink-ejection openings 108.

In the present embodiment, the ejection signal including one or a plurality of a voltage pulse or pulses is outputted from the driver ICs 51*a*-51*d*, and a positive predetermined potential is applied to the individual electrodes 135 in advance. Then, the ground potential is temporarily applied to the individual electrodes 135 each time when the ejection of the ink is required, and then the predetermined potential is applied again to the individual electrodes 135 at a predetermined timing. In this case, at the timing when the individual electrodes 135 become the ground potential, a negative pressure wave is produced in the pressure chambers 110. The negative pressure wave is transmitted from each of the pressure chambers 110 toward opposite ends of a corresponding one of the individual ink channels 132, then is reversed to positive at a position near the outlets of the sub-manifold channels 105*a*, and then is returned to the pressure chambers 110 again. The timing at which the predetermined potential is applied to the individual electrodes 135 corresponds to a timing at which the reversed pressure wave is returned to the pressure chambers 110. That is, the ink is sucked from the sub-manifold channels 105*a* by the negative pressure produced in the pressure chambers 110. When the predetermined potential is applied to the individual electrodes 135 at the timing when the ink has reached the pressure chambers 110, a pressure of the ink in the pressure chambers 110 rises, whereby the ink droplets are ejected from the ink-ejection openings 108.

A width of each of the voltage pulse(s) applied to the individual electrodes 135 is a length of time AL (Acoustic Length) in which the pressure wave is propagated from the outlets of the sub-manifold channels 105*a* to the ink-ejection openings 108 via the ink as a medium as described below. The width of each of the voltage pulse(s) included in the ejection signal is set as thus described, whereby (a) the pressure wave made positive by being reversed at the opposite ends of each individual ink channel 132 and (b) the positive pressure wave produced at the timing when the predetermined potential is applied to the corresponding individual electrode 135 are superposed on each other in the corresponding pressure chamber 110. Thus, the ink droplets can be ejected from the ink-ejection openings 108 in a state in which a height of the voltage pulse(s) is relatively low.

In order to drive the actuator units 21 such that the ink droplets are not ejected from the ink-ejection openings 108, a vibration signal including a plurality of voltage pulses each of which has a lower height beyond a specific value than the voltage pulse(s) included in the ejection signal and/or a vibration signal including a plurality of voltage pulses each of which has a narrower or wider pulse width beyond a specific value than the length of time AL are or is applied to the individual electrodes 135. In each case, since an amplitude of the pressure wave produced in the pressure chambers 110 does not become large beyond a threshold required for the ejection, the ink droplets are not ejected from the ink-ejection openings 108, and fine vibrations are produced in a meniscus of the ink The ink near the ink-ejection openings 108 is agitated by the vibrations of the ink meniscus, thereby restraining thickening of the ink due to drying. Thus, an ink ejection failure is restrained. It is noted that, in the present embodiment, there is employed, as the vibration signal, the vibration signal including the plurality of voltage pulses each of which has the narrower pulse width beyond the specific value than the length of time AL.

Figure 9:
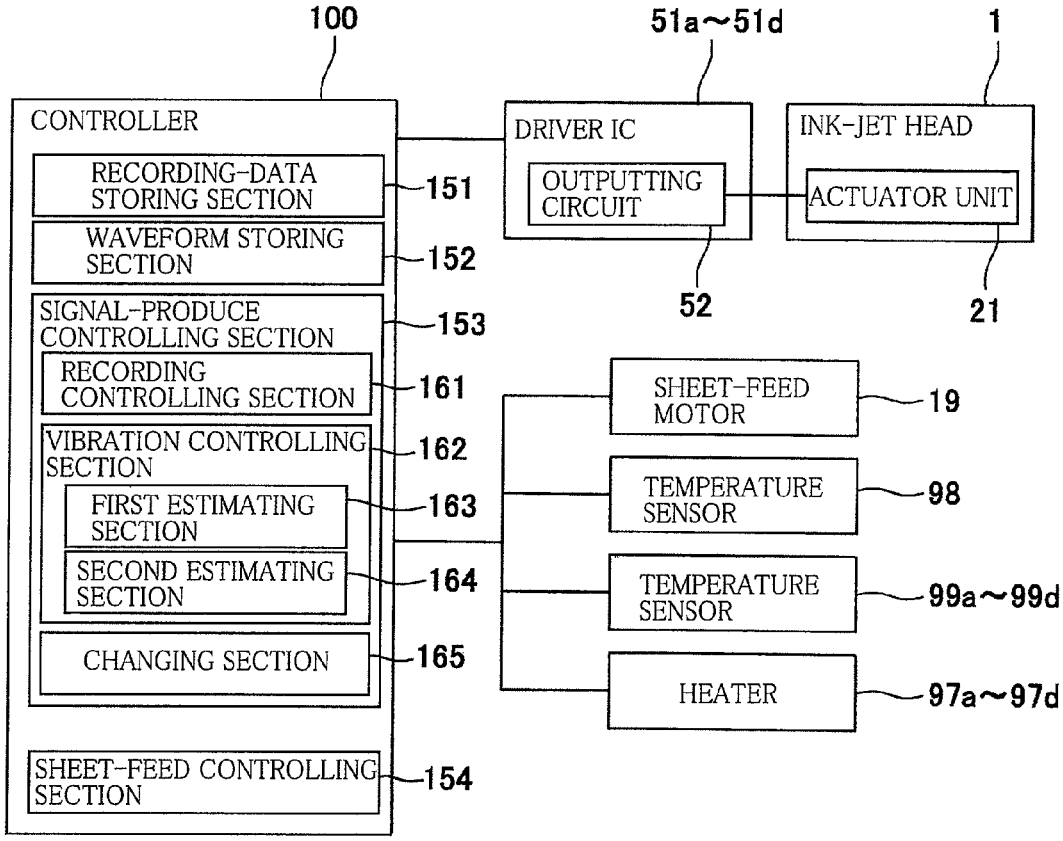
FIG. 9 is a functional block diagram of a controller.

There will be next explained the controller 100 in detail with reference to FIG. 9. The controller 100 includes a Central Processing Unit (CPU) as an arithmetic processing unit, a Read Only Memory (ROM) storing programs performed by the CPU and data used for the program, a Random Access Memory (RAM) for temporarily storing data when performing the program, and other logic circuits. These components are integrally functioned, whereby the controller 100 configures functioning sections which will be described below. It is noted that FIG. 9 schematically shows only one of the four ink-jet heads 1.

As shown in FIG. 9, the controller 100 includes a recording-data storing section 151, a waveform storing section 152, a signal-produce controller 153, and a sheet-feed controller 154. Further, the temperature sensors 98, 99*a*-99*d* and the heaters 97*a*-97*d* are connected to the controller 100.

The recording-data storing section 151 is configured to store recording data transmitted from a host computer, not shown. The recording data includes image data relating to an image to be formed on the sheet P. The image data is a group of dot data indicating an amount of a liquid ejected from the ink-ejection openings 108, to one of which each of dots of the image is corresponded. The image data has a type of drive data for driving the actuator units 21 by a recording controller 161 which will be described below. That is, the drive data indicate an amount of the ink ejected from each of the ink-ejection openings 108 in each of recording periods (recording cycles). Specifically, the drive data indicate that the amount of the ink ejected from each ink-ejection opening 108 in each recording period is one of four levels or settings (i.e., a small amount, a medium amount, a large amount, and no amount). Here, with reference to FIG. 10, the "small amount" corresponds to an ejection waveform W1 described below, the "medium amount" corresponds to an ejection waveform W2 described below, the "large amount" corresponds to an ejection waveform W3 described below, and the "no amount" corresponds to a non-ejection waveform W4 described below.

The waveform storing section 152 stores twelve unit waveforms and outputs the twelve unit waveforms to the respective outputting circuits 52 of the driver ICs 51*a*-51*d* in parallel. In the present embodiment, with reference to FIG. 10, the ejection waveforms W1, W2, W3, the non-ejection waveform W4, and the vibration waveforms S1, S2 are prepared. Each of the ejection waveforms W1-W3 is a unit waveform for producing the ejection signal which causes the ink to be ejected from the ink-ejection openings 108. The non-ejection waveform W4 is a unit waveform for producing the non-ejection signal which causes the ink not to be ejected from the ink-ejection openings 108 and also causes the ink near the ink-ejection openings 108 not to vibrate. Each of the vibration waveforms S1, S2 is a unit waveform for producing the vibration signal for causing the ink not to be ejected from the ink-ejection openings 108 and the ink near the ink-ejection openings 108 to vibrate.

These six unit waveforms have the same length of time (one recording period), and are used when the one recording period is 50i sec (drive frequency: 20 kHz). It is noted that the one recording period corresponds to a time required that the sheet is fed by a predetermined distance (i.e., a minimum dot pitch) corresponding to a recording resolution in the sub-scanning direction.

Figure 10:
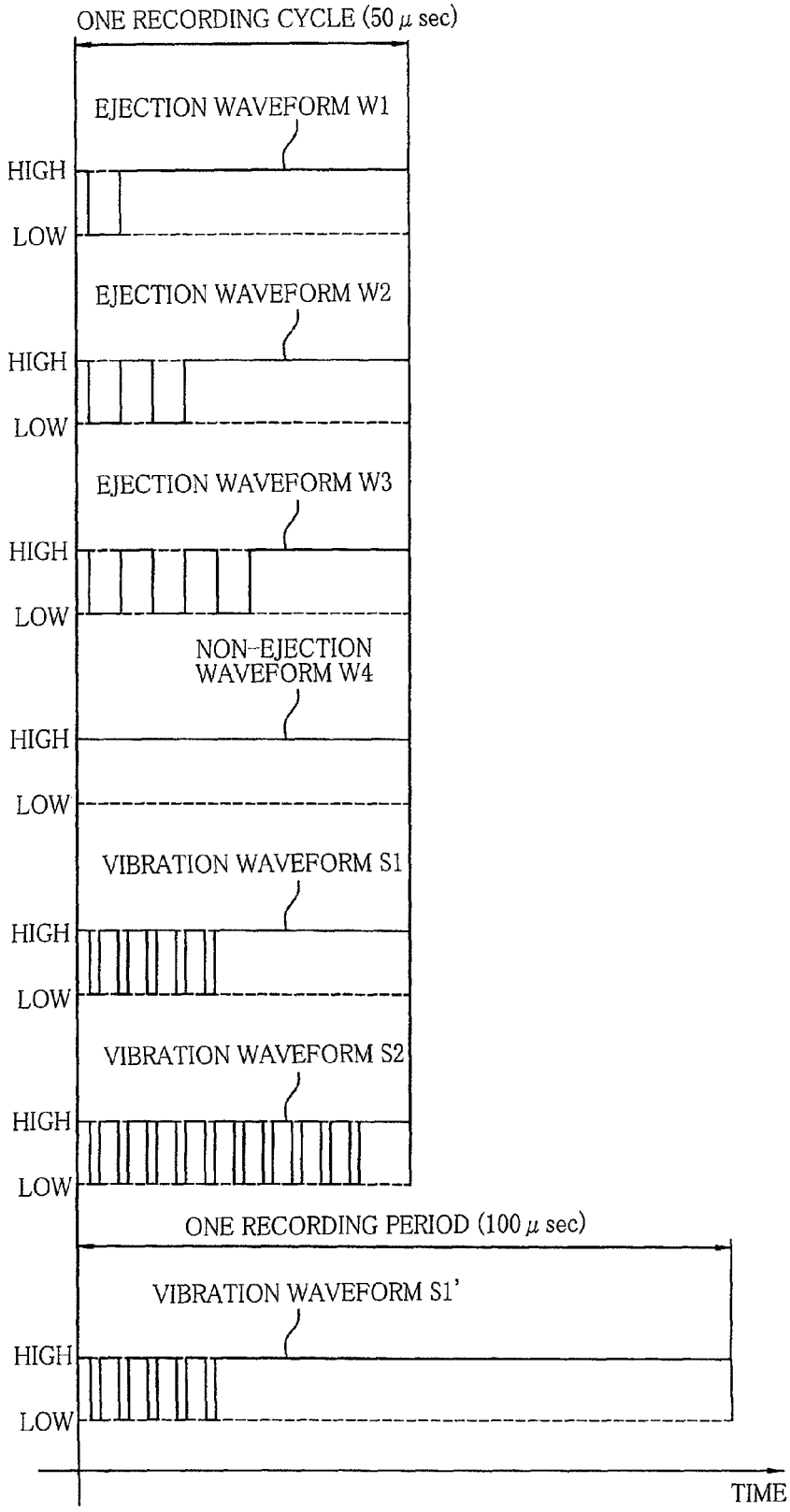
FIG. 10 is a schematic view of unit waveforms outputted by an outputting circuit.

Further, in the waveform storing section 152, there are prepared ejection waveforms W1', W2', W3', a non-ejection waveform W4', and vibration waveforms S1', S2' used when the one recording period is 100i sec (drive frequency: 10 kHz). It is noted that since there is only a small difference between the waveforms W1, W2, W3, W4, S1, S2 and the waveforms W1', W2', W3', W4', S1', S2', that is, a unit waveform of each of the waveforms W1', W2', W3', W4', S1', S2' has one recording period twice as long as that of a unit waveform of each of the waveforms W1, W2, W3, W4, S1, S2 in the length of time by adding, to the unit waveform of each of the waveforms W1, W2, W3, W4, S1, S2, a high-level period whose length is the same as that of the one recording period of each of the waveforms W1, W2, W3, W4, S1, S2, FIG. 10 shows only one of the waveforms W1', W2', W3', W4', S1', S2' as an example.

The ejection signals, the non-ejection signal, and the vibration signals are ones made by amplifying the above-described twelve unit waveforms by the respective outputting circuits 52 of the driver ICs 51*a*-51*d*. A low level potential of each signal is set to the ground potential, and a high level potential of each signal is set to a positive first predetermined potential (for example, 24V). This amplification is performed for each of the individual electrodes 135 in each of the recording periods, and one amplifying subject waveform is selected from the twelve unit waveforms on the basis of an ejection-selecting signal and a vibration-selecting signal as described below. It is noted that, in the present embodiment, in addition to the above-described vibration signal, there is also used, as the vibration signal, a vibration signal amplified by the respective outputting circuits 52 of the driver ICs 51*a*-51*d* such that a low level potential of each of the vibration waveforms S2, S2' is the ground potential while a high level potential thereof becomes a second predetermined potential (for example, 36V) higher than the first predetermined potential.

Here, there will be explained the unit waveform. As shown in FIG. 10, the ejection waveforms W1, W2, W3 respectively include one, two, and three pulses. A width of each pulse included in the ejection waveforms W1-W3 (a pulse transferred from the high level potential to the low level potential, and then returned to the high level potential) is equal to the AL. Thus, when the ejection signal is applied to the individual electrodes 135, an amplitude of the pressure wave produced in the pressure chambers 110 becomes large beyond the threshold required for the ejection, whereby the ink is ejected from the ink-ejection openings 108. In this time, each one of the pulse(s) included in the ejection waveforms W1-W3 corresponds to one ink droplet ejected from one of the ink-ejection openings 108. An amount of the ink ejected in one ejection is constant. Thus, an amount of the ink ejected by the ejection waveform W2 is twice as large as an amount of the ink ejected by the ejection waveform W1, and an amount of the ink ejected by the ejection waveform W3 is three times as large as an amount of the ink ejected by the amount of the ink ejected by the ejection waveform W1. Further, a distance between pulses of each of the ejection waveforms W2, W3 is equal to the AL. Here, when the ejection signal is applied to each of the individual electrodes 135, the ink droplets whose number is according to the ejection waveforms W1-W3 are ejected from the corresponding ink-ejection openings 108, whereby one dot is formed on the sheet in each of the ejection waveforms W1-W3.

The non-ejection waveform W4 is always kept at the high level potential. Thus, even where the non-ejection signal produced on the basis of the non-ejection waveform W4 is applied to the individual electrodes 135, the ink is not ejected from the ink-ejection openings 108, so that the fine vibration is not produced in the meniscus of the ink.

Further, the vibration waveforms S1, S2 respectively include five and ten pulses. A width of each pulse included in the vibration waveforms S1, S2 is about half of the AL and equal to or less than the above-described specific value. Thus, even where the vibration signal produced on the basis of the vibration waveforms S1, S2 is applied to the individual electrodes 135, the ink is not ejected though the ink meniscus formed in the ink-ejection openings 108 is vibrated. An amount of heat (i.e., a heat amount) generated when the vibration signal is applied to the individual electrodes 135 is in proportion to a number of the pulses included in the vibration signal. For example, a heat amount generated when the vibration signal produced on the basis of the vibration waveform S1 is applied to the individual electrodes 135 is half of a heat amount generated when the vibration signal produced on the basis of the vibration waveform S2 is applied. Further, the heat amount generated when the vibration signal is applied to the individual electrodes 135 is in proportion to a square of a pulse height included in the vibration signal. That is, the heat amount generated when the vibration signal amplified such that the high level potential of the vibration waveform S2 becomes the first predetermined potential is applied to the individual electrodes 135 is $1/2.25$ of the heat amount generated when the vibration signal amplified such that the high level potential of the vibration waveform S2 becomes the second predetermined potential is applied.

The signal-produce controller 153 includes the recording controller 161, a vibration controlling section 162, and a changing section 165. The recording controller 161 is configured to output the ejection-selecting signal to the outputting circuits 52 on the basis of the stored drive data. The ejection-selecting signal is outputted in each of the recording periods to command the waveform (W1-W4) of the signal applied to each of the individual electrodes 135. Each of the outputting circuits 52 selects one of the ejection waveforms W1-W3 and the non-ejection waveform W4 on the basis of the ejection-selecting signal and applies the selected waveform to each individual electrode 135 as the ejection signal and the non-ejection signal amplified such that the high level potential of the waveform becomes the first predetermined potential.

The vibration controlling section 162 is configured to output, upon turning on the printer 101 (Le., just after a start of an operation of the printer 101), the vibration-selecting signal to the outputting circuits 52 where an average ink temperature in the reservoir channel 74 (an average value in the four temperature sensors 99*a*-99*d*) which is an average temperature of the four temperatures respectively detected by the temperature sensors 99*a*-99*d* is lower than a predetermined temperature. In this time, the vibration-selecting signal functions as a signal commanding the vibration waveform S2 where the average ink temperature is lower than a threshold temperature, and functions as a signal commanding the vibration waveform S1 where the average ink temperature is equal to or more than the threshold temperature. Further, in this time, the number of the individual electrodes 135 to which the vibration signal is supplied is increased in accordance that the detected ink temperature becomes low. Each of the outputting circuit 52 selects one of the two vibration waveforms S1, S2 on the basis of the vibration-selecting signal, and supplies the selected waveform to the corresponding individual electrodes 135 as a vibration signal amplified such that the high level potential thereof becomes the first predetermined potential.

As a result, when the printer 101 is turned on, and the ink temperature is lower than the predetermined temperature, the driver ICs 51*a*-51*d* generate heat to heat the reservoir unit 70 before the recording. Thus, the ink in the reservoir channel 74 is heated and the ink in the ink channels of the channel unit 9 is also heated via the reservoir unit 70, whereby the ink ejection failure occurs less frequently. Further, depending upon the detected ink temperature, the one of the vibration waveforms S1, S2 to be selected and the number of the individual electrodes 135 supplying the signal are changed, thereby restraining electric power consumption.

It is noted that the control of the vibration controlling section 162 in this time is performed for a predetermined length of time since the printer 101 is turned on such that the ink in the head becomes a temperature equal to or more than the predetermined temperature, but where the recording data is transmitted to the controller 100 before the predetermined length of time has passed, the vibration of the ink meniscus is forced to be finished. On the other hand, where the recording data is not transmitted to the controller 100 after the predetermined length of time has passed, the above-described control may be performed at regular intervals over a period until the recording data is transmitted. As a result, the ink ejection failure occurs much less frequently.

The vibration controlling section 162 includes a first estimating section 163 and a second estimating section 164. The first estimating section 163 is configured to calculate in advance an amount of the ink ejected from the ink-ejection openings 108 in a predetermined period (i.e., a period from a start of recording on one sheet P to an end of the recording), i.e., an amount of the ink (an ink amount V) to be flowed into the ink channel of the head 1 (i.e., the reservoir channel 74) on the basis of the stored drive data. Further, the first estimating section 163 is configured to estimate in advance a heat amount Q1 by which the ink to be flowed into the head 1 in the predetermined period deprives the head 1 of heat, on the basis of the calculated ink amount V, a temperature of the ink (i.e., an ink temperature T2) to be flowed into the head 1 which temperature has been detected by the temperature sensor 98, and an average ink temperature T1 (i.e., an internal channel liquid temperature) in the reservoir channel 74 which has been detected by the temperature sensors 99*a*-99*d*.

Specifically, a head temperature T1' after being changed by the flow of the ink into the reservoir channel 74 is obtained by the following expression (1). Expression (1) represents a balance of heat before and after the ink is flowed into. Further, a variation of a volume of the ink by the temperature is ignored here.

$$\alpha T2V+\alpha T1V1+\beta T1V2=\alpha T1'(V+V1)+\beta T1'V2 \quad (1)$$

Here, "α" represents a specific heat capacity of the ink (cal/k·cm$^3$), "β" represents a specific heat capacity of the reservoir unit 70 (specifically, only solid portions thereof exclusive of channel portions thereof), "V1" represents an amount of the ink in the reservoir unit 70 (exclusive of a discharged ink whose amount is the same as that of an inflow ink), and "V2" represents a volume of the reservoir unit 70 (specifically, only the solid portions thereof exclusive of the channel portions thereof). Then, "Q1" is calculated by substituting the calculated T1' into the following expression (2), whereby the heat amount Q1 is assumed. Expression (2) represents the heat amount obtained by the inflow ink. This heat amount is equal to the heat amount by which the head 1 is deprived of heat.

$$Q1=\alpha(T1'-T2)\times V \quad (2)$$

The second estimating section 164 is configured to assume in advance a total heat amount Q2 of the heat generated by the driver ICs 51*a*-51*d* in the predetermined period, on the basis of the stored drive data by supplying the ejection signal to the individual electrodes 135.

The vibration controlling section 162 outputs the vibration-selecting signal to the outputting circuits 52 where the average ink temperature in the reservoir channel 74 is lower than the predetermined temperature even in times other than a time just after the printer 101 is turned on. The vibration-selecting signal commands the vibration waveform (S1 and S2) and a value of the high level potential (the first predetermined potential and the second predetermined potential) depending upon the ink temperature. Each of the outputting circuit 52 to which the vibration-selecting signal is inputted in this time corresponds to at least one of the individual electrodes 135 to which the non-ejection signal is applied. At least one of the outputting circuits 52 selects one of the vibration waveforms S1, S2 on the basis of the vibration-selecting signal and applies the selected vibration waveform to the individual electrodes 135 after amplifying such that the vibration waveform is at a commanded potential. To the individual electrodes 135 is applied the vibration signal instead of the non-ejection signal.

In this time, the vibration controlling section 162 outputs the vibration-selecting signal to the outputting circuits 52 in the predetermined period by supplying the vibration signal to ones of the individual electrodes 135 whose number is required for an entirety of the four driver ICs 51*a*-51*d* to generate an amount of heat larger than a heat amount Q3 obtained by subtracting the heat amount Q2 from the heat amount Q1. It is noted that, in the present embodiment, the heat amount at least larger than the heat amount Q3 is a heat amount in which the ink in the head 1 and the ink flowed thereinto can be heated to a temperature equal to or more than the predetermined temperature. Further, an amount of heat released by the head 1 to ambient air and a component for mounting the head 1 is taken into consideration to obtain the heat amount Q3.

As thus described, where the average ink temperature is equal to or more than the predetermined temperature, the signal-produce controller 153 performs the control to command one of the ejection signal and the non-ejection signal which is to be supplied to each of the individual electrodes 135 in each recording period on the basis of the drive data. On the other hand, where the average ink temperature is lower than the predetermined temperature, the signal-produce controller 153 performs a control to command the ejection signal, the non-ejection signal, and the vibration signal to be supplied to each individual electrode 135 in each recording period on the basis of the drive data, while satisfying a condition that the vibration signal is supplied in at least one recording period to at least one of the individual electrodes 135 to which the non-ejection signal is supplied in at least one recording period in the predetermined period when the average ink temperature is equal to or more than the predetermined temperature. It is noted that the number of the individual electrodes 135 to which the vibration signal is supplied may be equal to or smaller than the number of the individual electrodes 135 to which the non-ejection signal is supplied.

Further, in this time, in accordance that a difference (i.e., a temperature difference) between the ink temperature T1 and the ink temperature T2 becomes large, the vibration controlling section 162 outputs, to the outputting circuits 52, the vibration-selecting signal in which the total number of drivings of the individual electrodes 135 to which the vibration signal is supplied in each recording period is increased. Further, in this time, where the temperature difference between the ink temperature T1 and the ink temperature T2 is less than a first predetermined value, the vibration controlling section 162 causes the outputting circuits 52 to select the vibration waveform S1. On the other hand, where the temperature difference is equal to or more than the first predetermined value and less than a second predetermined value, the vibration controlling section 162 causes the outputting circuits 52 to select the vibration waveform S2. In both cases, the high level potential is the first predetermined potential. Further, where the temperature difference between the ink temperature T1 and the ink temperature T2 is equal to or more than the second predetermined value, the vibration controlling section 162 causes the outputting circuits 52 to select the vibration waveform S2. The high level potential in this case is the second predetermined potential. By these controls, in accordance that the temperature difference between the ink temperature T1 and the ink temperature T2 becomes large, the heat amount of the heat generated by the driver ICs 51*a*-51*d* is increased. Thus, the ink in the head 1 and the ink flowed thereinto can be effectively heated.

Further, in accordance that an amount (hereinafter may be referred to as an "inflow ink amount") of the ink to be flowed into the head 1 in the predetermined period becomes large, the vibration controlling section 162 may output, to the outputting circuits 52, the vibration-selecting signal in which the above-described total number of the drivings of the individual electrodes 135 is increased.

Further, the vibration controlling section 162 may perform a control based on the inflow ink amount. Where the inflow ink amount is smaller than a first predetermined amount, the vibration controlling section 162 causes the outputting circuits 52 to select the vibration waveform S1. On the other hand, where the inflow ink amount is equal to or more than the first predetermined amount and smaller than a second predetermined amount, the vibration controlling section 162 causes the outputting circuits 52 to select the vibration waveform S2. In both cases, the high level potential may be the first predetermined potential. Further, where the inflow ink amount is equal to or more than the second predetermined amount, the vibration controlling section 162 causes the outputting circuits 52 to select the vibration waveform S2. The high level potential in this case may be the second predetermined potential. By these controls, in accordance that the inflow ink amount becomes large, the heat amount of the heat generated by the driver ICs 51*a*-51*d* is increased. Thus, like the above-described controls, the ink in the head 1 and the ink flowed thereinto can be effectively heated.

Further, the vibration controlling section 162 may perform the control based on the inflow ink amount as just mentioned in addition to the above-described control based on the temperature difference. For example, an explanation will be given assuming that only the first predetermined value is set as the threshold value relating to the temperature difference. Where the temperature difference is less than the first predetermined value, a difference of a content of the control with respect to the inflow ink amount is as described above. Where the temperature difference is equal to or more than the first predetermined value and where the inflow ink amount is smaller than the first predetermined amount, the vibration controlling section 162 causes the outputting circuits 52 to select the vibration waveform S2. The high level potential in this case is the first predetermined potential. Where the inflow ink amount is equal to or more than the first predetermined amount and smaller than the second predetermined amount, the vibration controlling section 162 causes the outputting circuits 52 to select the vibration waveform S2, but makes the high level potential be the second predetermined potential. Further, where the inflow ink amount is equal to or more than the second predetermined amount, the vibration controlling section 162 causes the outputting circuits 52 to select a new vibration waveform though a setting of this new vibration waveform is required. The high level potential in this case is the second predetermined potential. In this case, the new vibration waveform includes more pulses than the vibration waveform S2. Alternately, though the vibration controlling section 162 causes the outputting circuits 52 to select the vibration waveform S2, the high level potential may be a potential greater than the second predetermined potential.

The content of the control of the vibration controlling section 162 with respect to each outputting circuit 52 is not limited to a combination of the above-described levels relating to the temperature difference and the inflow ink amount. That is, there may be set the number of the pulses included in the vibration waveform and a drive voltage (i.e., the value of the high level potential) in accordance with the number of the levels.

Further, in a non-recording period, in which the image is not recorded on the sheet P, in the predetermined period, the vibration controlling section 162 causes each outputting circuit 52 to select one of the vibration waveforms S1, S2 and makes the high level potential be the first predetermined potential or the second predetermined potential with regard to the plurality of individual electrodes 135. As a result, the driver ICs 51*a*-51*d* can be operated to generate the heat even in the non-recording period, so that the ink can be efficiently heated. Further, in this time, the signal may be applied in a state in which the vibration waveform is selected with respect to all the individual electrodes 135. In both cases, the ink meniscus in the ink-ejection openings 108 is vibrated, thereby restraining the thickening of the ink caused in the non-recording period.

It is noted that, the predetermined period means the recording period in which the recording is performed on one sheet P and a continuous recording period in which the recording is continuously performed on the plurality of sheets. That is, the predetermined period includes a plurality of the recording periods. Further, the non-recording period can refer to a period in the predetermined period, in which the non-ejection signal is supplied to all the individual electrodes 135 to which the signal is supplied from the outputting circuit 52 of the driver IC 51*a*. Furthermore, the non-recording period can also refer to a period in the predetermined period, in which the non-ejection signal is supplied to all the individual electrodes 135 to which the signal is supplied from each of the driver ICs 51*a*-51*d*.

Further, in this time, the vibration controlling section 162 individually controls the heat amount of the heat generated by the driver ICs 51*a*-51*d* in accordance with the ink temperature detected by the four temperature sensors 99*a*-99*d*. For example, where the ink temperature detected by the temperature sensor 99*a* among the four temperature sensors 99*a*-99*d* is the lowest, the vibration controlling section 162 increases, compared with the other driver ICs, an amount of heat generated by the driver IC 51*a* in the predetermined period with the one recording period being as a unit. For example, the vibration controlling section 162 outputs, to the outputting circuit 52 of the driver IC 51*a*, the vibration-selecting signal such that the total number of the drivings of the individual electrodes 135 to which the vibration signal is supplied becomes the largest. In this time, as described above, in according to the combination of the temperature difference and the inflow ink amount, there may be changed the combination of the vibration signal (S1 or S2) to be selected and its high level potential value (the first predetermined potential or the second predetermined potential).

As a result, the ink having a relatively low temperature can be heated efficiently. Thus, it is made possible to eliminate waste driving of the driver ICs 51*b*-51*d* which heat the ink having a relatively high temperature. As a result, the driving of the driver ICs 51*a*-51*d* can be restrained to the minimum necessity, thereby reducing the electric power consumption.

Further, the manifold channels 105, the partial channels 74*a*-74*d*, the temperature sensors 99*a*-99*d*, and the heaters 97*a*-97*d* are disposed in correspondence with the placement of the respective actuator units 21. When the actuator units 21 are driven to eject the ink from the ink-ejection openings 108, the ink is flowed into the respective manifold channels 105 mainly from the respective partial channels corresponding to the actuator units 21. The ink in the partial channels is mainly heated by the heat generation of the respective driver ICs 51*a*-51*d*. The temperature sensor 99 detects the temperature of the ink in the corresponding partial channels, and the vibration controlling section 162 individually controls the amount of the heat generated by the driver ICs 51*a*-51*d* in accordance with the detected ink temperature as described above. That is, the vibration controlling section 162 performs a control of the temperature of the ink in each of the manifold channels 105. As a result, the temperature of the ink can be minutely controlled in each of the manifold channels 105 which corresponds to one of the actuator units 21.

Further, the vibration controlling section 162 may apply the vibration signal instead of the non-ejection signal to one or ones of the individual electrodes 135 to which the non-ejection signal is supplied over a predetermined number of the recoding periods even where the average ink temperature in the reservoir channel 74 is equal to or more than the predetermined temperature. That is, the vibration controlling section 162 causes the outputting circuits 52 to select one of the vibration waveforms S1, S2 instead of the non-ejection waveform W4. In this time, the high level potential is the first predetermined potential or the second predetermined potential in accordance with the combination of the temperature difference and the inflow ink amount. As a result, since the vibration signal is applied to the one or ones of the individual electrodes 135 while the non-ejection signal is continued to be applied to the individual electrode(s) 135, the ink near the ink-ejection openings 108 is agitated, thereby restraining the ink ejection failure owing to the thickening of the ink.

Where there is assumed that the vibration signal is supplied to all the individual electrodes 135, the changing section 165 judges, as a judging section, in advance whether the heat amount generated by the entirety of the driver ICs 51*a*-51*d* in the predetermined period exceeds the heat amount Q3 or not. Where this heat amount exceeds the heat amount Q3, the changing section 165 does not perform a change. That is, each of the driver ICs 51*a*-51*d* is driven in accordance with a content of the command of the ejection-selecting signal outputted by the recording controller 161 and a content of the command of the vibration-selecting signal outputted by the vibration controlling section 162. Detailed operations of these components are as described above.

On the other hand, where the heat amount generated by the entirety of the driver ICs 51*a*-51*d* does not exceed the heat amount Q3, the changing section 165 changes the content of the command of the ejection-selecting signal outputted by the recording controller 161 and the content of the command of the vibration-selecting signal outputted by the vibration controlling section 162. Specifically, the ejection-selecting signal causes each outputting circuit 52 to select one of the ejection waveforms W1', W2', W3', and the non-ejection waveform W4' on the basis of the stored drive data. Further, the ejection-selecting signal causes each outputting circuit 52 to select one of the vibration waveforms S1', S2' on the basis of the stored drive data for at least one of the individual electrodes 135 to which the non-ejection signal W4' is supplied. It is noted that, whether the vibration waveform is amplified such that the high level potential is the first predetermined potential or the second predetermined potential is as in the case where the heat amount exceeds the heat amount Q3.

Further, the changing section 165 controls the sheet-feed controller 154 such that a velocity of the sheet-feed motor 19 from a first feeding velocity to a second feeding velocity which will be described below. That is, a printer operation in a case where the heat amount generated by the entirety of the driver ICs 51*a*-51*d* does not exceed the heat amount Q3 is as in the case where the heat amount exceeds the heat amount Q3 except where each recording period is doubled (to 100i sec).

It is noted that, in the present embodiment, only two types of the vibration waveforms whose recording periods are different from each other are prepared, but equal to or more than three types of the vibration waveforms may be prepared. In a case of this modification, the changing section may control the vibration controlling section such that each outputting circuit 52 selects a vibration waveform in which a time length of each recording period becomes longer or is lengthened in accordance that the temperature difference between the ink temperature T1 and the ink temperature T2 becomes large. Further, the changing section may control the vibration controlling section such that each outputting circuit 52 selects the vibration waveform in which the time length of each recording period becomes longer in accordance that the amount of the ink to be flowed into the head in the predetermined period becomes large.

As thus described, the changing section 165 performs the changing operation in which the time length of each recording period becomes longer, whereby the amount of the ink to be flowed into the head 1 in a unit time becomes small, and accordingly the heat generated by the driver ICs 51*a*-51*d* is more likely to be transferred to an entirety of the head 1 (mainly the reservoir unit 70). As a result, the ink in the ink channels of the head 1 and the ink flowed thereinto can be effectively heated. Further, the ink temperature in the head 1 can be reliably increased.

Further, where the heat amount generated by the entirety of the driver ICs 51*a*-51*d* does not exceed the heat amount Q3, the changing section 165 energizes the four heaters 97*a*-97*d* to compensate the heat amount given to the head 1. As a result, a heat amount which is insufficient with only the heat generated by the driver ICs 51*a*-51*d* can be compensated with the heaters 97*a*-97*d*. Thus, the temperature of the ink can be reliably controlled.

The sheet-feed controller 154 controls the sheet-feed motor 19 such that the sheet P is fed at a predetermined feeding velocity. It is noted that the predetermined feeding velocity includes two types, namely, the first feeding velocity used where the one recording period is 50i sec and the second feeding velocity used where the one recording period is 100i sec. The second feeding velocity is a velocity half of the first feeding velocity. The sheet-feed controller 154 normally controls the sheet-feed motor 19 such that the sheet P is fed at the first feeding velocity. However, by the changing operation of the changing section 165 described above, the sheet-feed controller 154 controls the sheet-feed motor 19 such that the sheet P is fed at the second feeding velocity.

As described above, according to the ink-jet printer 101 as the present embodiment, even where the ink in the ink channels in the head 1 and the ink flowed thereinto have a relatively low ink temperature and a relatively high ink viscosity, the signal-produce controller 153 controls the driver ICs 51*a*-51*d* to generate the heat whose amount is larger than the heat amount Q3. Thus, the ink in the ink channels and the ink flowed thereinto are heated to a temperature equal to or more than the predetermined temperature, thereby lowering the ink viscosity. Consequently, there is eliminated a need for increasing an ink ejection energy for ejecting, from the ink-ejection openings 108, the ink droplets having the same amount as at ordinary temperatures, thereby maintaining electric power consumption for the ink ejection. Further, there is eliminated a need for providing heat sinks and the like for cooling the driver ICs 51*a*-51*d* having generated the heat, thereby simplifying the construction of the ink-jet heads 1. Further, there is obviated unevenness of an appropriate amount of the ink according to the viscosity of the ink, thereby contributing to maintaining of an image quality.

While the preferred embodiment of the present invention has been described, it is to be understood that the present invention is not limited to the details of the illustrated embodiment, but may be embodied with various changes and modifications, which may occur to those skilled in the art, without departing from the spirit and scope of the present invention. For example, in the above-described embodiment, the heat amount exceeding or larger than the heat amount Q3 may simply exceed the heat amount Q3 and may also be an amount in which the ink in the head 1 and the ink flowed thereinto are heated to a temperature lower than the predetermined temperature. Further, the vibration signal may be supplied in the predetermined period to only one or ones of the individual electrodes 135 to which the non-ejection signal is supplied. That is, the vibration signal may not be supplied to the individual electrodes 135 upon turning on the printer 101, in the non-recording period, and the like.

Further, in the above-described embodiment, any of a plurality of types of the vibration signals is supplied to the individual electrodes 135 instead of the non-ejection signal in each recording period on the basis of the drive data, but only one type of the vibration signal may be supplied to the individual electrodes 135. That is, the vibration controlling section 162 may not output, to the outputting circuits 52, the vibration-selecting signal for causing the outputting circuits 52 to select the vibration waveform S2 having more pulses than the vibration waveform S 1. Further, the vibration controlling section 162 may not increase the total number of the drivings of the individual electrodes 135 to which the vibration signal is supplied, in accordance that the temperature difference between the ink temperature T1 and the ink temperature T2 becomes large and in accordance that the amount of the ink to be flowed into the head becomes large. Further, the vibration controlling section 162 may not control the amount of the heat generated by the driver ICs 51*a*-51*d* depending upon the ink temperature detected by the four temperature sensors 99*a*-99*d*. In these cases, the control is simplified. Furthermore, in the above-described embodiment, the temperature sensors 99*a*-99*d* are fixed to the side face 70*b* or the side face 70*c* of the reservoir unit 70, but the present invention is not limited to this construction. For example, the temperature sensors 99*a*-99*d* may be disposed at positions distant from the reservoir unit 70 with a space interposed therebetween. Further, the temperature sensors 99*a*-99*d* may also be respectively disposed on the driver ICs 51*a*-51*d* directly fixed to the metal plate 71 of the reservoir unit 70. Where the reservoir unit 70 and the metal plate 71 are thermally connected to each other, it is possible to detect the temperature of the ink in the reservoir channel 74 also on the driver ICs 51*a*-51*d*. Further, the temperature of the ink in the reservoir channel 74 may be estimated using driver-IC temperature sensors respectively disposed on the diver ICs 51*a*-51*d* for detecting temperatures of the respective diver ICs 51*a*-51*d*, and then perform the calculations and the controls in the above-described embodiment using the estimated temperature of the ink. In this case, there is eliminated a need for providing the temperature sensors 99*a*-99*d* on the reservoir unit 70, thereby reducing the manufacturing cost.

Further, the changing section 165 may not be provided. Further, only one driver IC may be provided on each ink-jet head. Furthermore, the heaters 97*a*-97*d* may not be particularly provided because the heaters 97*a*-97*d* are supplementary components. In this case, there is eliminated a need for providing the heater for heating the ink in the ink channels of the head and the ink flowed thereinto, thereby reducing a manufacturing cost.

Further, the reservoir unit may not be provided. In this case, the temperature sensors 99*a*-99*d* and the driver ICs 51*a*-51*d* may be provided on the channel unit 9. In this case, the temperature sensors 99*a*-99*d* and the driver ICs 51*a*-51*d* may be disposed in correspondence with the four manifold channels 105 instead of the partial channels 74*a*-74*d* described above. Further, only one temperature sensor which detects the ink temperature in the ink channel may be provided on the ink-jet heads 1.

Further, in the above-described embodiment, from the viewpoint that the ink supplied to the channel unit 9 is effectively heated, the heaters 97*a*-97*d* are disposed so as to be opposed to the ink-outlet channels 73*a* of the reservoir unit 70. However, from the viewpoint that the temperature of the ink supplied to the channel unit 9 is measured more accurately, the temperature sensors 99*a*-99*d* may be disposed so as to be opposed to the ink-outlet channels 73*a*. That is, the heaters 97*a*-97*d* and the temperature sensors 99*a*-99*d* may have a reverse positional relationship to each other.

Further, the manifold channels 105 are separated from each other in correspondence with the placement of the actuator units 21, but the present invention is not limited to this construction. For example, all the manifold channels may be communicated with each other in a longitudinal direction of the heads 1.

Further, the above-described embodiment is one example in which the present invention is applied to an ink-jet printer including ink-jet heads configured to eject an ink from ink-ejection openings, but an object to which the present invention can be applied is not limited to the ink-jet printer of this type. For example, the present invention is applicable to various liquid ejecting apparatuses including liquid ejecting head which ejects conductive paste to form a wiring pattern on a circuit board, which ejects organic illuminant on a circuit board to form a high-definition display, or which ejects optical plastic on a circuit board to form a fine electronic device such as a light guide.

What is claimed is:

1. A liquid ejecting apparatus, comprising:

a liquid ejecting head including (a) a plurality of liquid-ejection openings from each of which a liquid droplet is ejected, (b) a liquid channel having a plurality of individual liquid channels each having one end as a corresponding one of the plurality of liquid-ejection openings, and (c) a plurality of actuators each of which applies, to a liquid in a corresponding one of the plurality of individual liquid channels, ejection energy that causes the liquid droplet to be ejected from a corresponding one of the plurality of liquid-ejection openings;

an inflow liquid temperature sensor which detects a temperature of the liquid to be flowed into the liquid channel from an outside;

a driver IC which is disposed so as to be thermally connected to the liquid ejecting head, which includes a signal producing circuit configured to produce (a) an ejection signal that causes the liquid droplet to be ejected from the liquid-ejection opening, (b) a non-ejection signal that causes the liquid droplet not to be ejected from the liquid-ejection opening and a liquid near the liquid-ejection opening not to be vibrated, and (c) a vibration signal that causes the liquid droplet not to be ejected from the liquid-ejection opening and the liquid near the liquid-ejection opening to be vibrated, and which supplies one of the produced signals to each of the plurality of actuators in each recording period; and a controller configured to control the driver IC, wherein the controller includes:

a storing section configured to store drive data of the plurality of actuators that indicate an amount of the liquid droplets ejected from the plurality of liquid-ejection openings in each recording period;

a first estimating section configured to estimate a first heat amount by which the liquid to be flowed into the liquid channel in a predetermined period including a plurality of the recording periods deprives the liquid ejecting head of heat on the basis of (a) an amount of the liquid to be flowed into the liquid channel by the ejection of the liquid droplets from the plurality of liquid-ejection openings on the basis of the stored drive data (b) an internal channel liquid temperature as a temperature of the liquid in the liquid channel, and (c) an inflow liquid temperature detected by the inflow liquid temperature sensor;

a second estimating section configured to estimate, on the basis of the stored drive data, a second heat amount generated by the driver IC in the predetermined period by supplying the ejection signal to the plurality of actuators by the signal producing circuit; and a signal-producing-circuit controlling section configured to cause the signal producing circuit to produce the ejection signal, the non-ejection signal, and the vibration signal in each recording period on the basis of the stored drive data such that one of the ejection signal, the non-ejection signal, and the vibration signal is supplied to each of the plurality of actuators, and wherein the signal-producing-circuit controlling section controls the signal producing circuit such that an increased heat amount exceeds a third heat amount obtained by subtracting the second heat amount from the first heat amount, the increased heat amount being as a heat amount of the driver IC which is increased by supplying, instead of the non-ejection signal supplied to each of at least one of the plurality of actuators, the vibration signal to each of at least one of the at least one actuator to which the non-ejection signal is supplied.

2. The liquid ejecting apparatus according to claim 1, further comprising an internal channel liquid temperature sensor which detects the temperature of the liquid in the liquid channel, wherein the internal channel liquid temperature is detected by the internal channel liquid temperature sensor.

3. The liquid ejecting apparatus according to claim 2, further comprising a liquid storing portion which stores the liquid, wherein the liquid channel of the liquid ejecting head further includes:

a reservoir channel which temporarily stores the liquid from the liquid storing portion; and a common liquid channel which connects the reservoir channel and the plurality of individual liquid channels, and wherein the driver IC is thermally connected to a defining member of the liquid ejecting head which partly defines the reservoir channel.

4. The liquid ejecting apparatus according to claim 3, wherein the liquid ejecting head is a laminated body including (a) a first channel member having the reservoir channel and (b) a second channel member having the plurality of liquid-ejection openings, the plurality of individual liquid channels, the common liquid channel, and the plurality of actuators, and wherein the second channel member has a smaller thermal capacity than the first channel member and is thermally connected to the driver IC via the first channel member.

5. The liquid ejecting apparatus according to claim 3, wherein the defining member partly defining the reservoir channel extends with the reservoir channel in one direction coinciding with a longitudinal direction of the defining member, wherein a plurality of driver ICs each as the driver IC are provided on the defining member partly defining the reservoir channel so as to be arranged in the one direction, and wherein a plurality of internal channel liquid temperature sensors each as the internal channel liquid temperature sensor are provided so as to be respectively adjacent to the plurality of driver ICs.

6. The liquid ejecting apparatus according to claim 5, wherein the signal-producing-circuit controlling section is configured to control the signal producing circuit on the basis of liquid temperatures detected by the plurality of internal channel liquid temperature sensors.

7. The liquid ejecting apparatus according to claim 3, further comprising a heater disposed so as to be thermally connected to the liquid ejecting head, wherein the controller further includes a judging section configured to judge whether the increased heat amount where the vibration signal is supplied to each of the plurality of actuators instead of the non-ejection signal in the predetermined period exceeds the third heat amount or not, and wherein the heater is operated where the judging section has judged that the increased heat amount does not exceed the third heat amount.

8. The liquid ejecting apparatus according to claim 7, wherein a plurality of actuator units respectively including the plurality of actuators are disposed so as to be arranged in the one direction, and wherein the common liquid channel, the driver IC, the heater, and the internal channel liquid temperature sensor are disposed in correspondence with a placement of each of the plurality of actuator units.

9. The liquid ejecting apparatus according to claim 1, further comprising:

a liquid storing portion which stores the liquid; and a connecting tube which connects the liquid storing portion and the liquid ejecting head to each other, wherein the inflow liquid temperature sensor is configured to detect a temperature of the liquid to be flowed into the liquid ejecting head from the liquid storing portion via the connecting tube.

10. The liquid ejecting apparatus according to claim 9, wherein the inflow liquid temperature sensor is fixed to the connecting tube.

11. The liquid ejecting apparatus according to claim 1, wherein the signal-producing-circuit controlling section is configured to control the signal producing circuit such that the increased heat amount exceeds the third heat amount where the internal channel liquid temperature is lower than a predetermined temperature.

12. The liquid ejecting apparatus according to claim 11, wherein the signal-producing-circuit controlling section is configured to control the signal producing circuit such that the temperature of the liquid in the liquid channel and the liquid to be flowed into the liquid channel in the predetermined period becomes a temperature equal to or more than the predetermined temperature.

13. The liquid ejecting apparatus according to claim 11, wherein the signal-producing-circuit controlling section is configured to control the signal producing circuit such that where the internal channel liquid temperature is lower than the predetermined temperature just after a start of an operation of the liquid ejecting apparatus, the vibration signal is supplied, instead of the non-ejection signal supplied to each of the at least one actuator, to each of the at least one of the at least one actuator to which the non-ejection signal is supplied.

14. The liquid ejecting apparatus according to claim 1, wherein the signal-producing-circuit controlling section is configured to control the signal producing circuit such that where a difference between the internal channel liquid temperature and the inflow liquid temperature is large, a total number of drivings of the actuators to which the vibration signal is supplied in the predetermined period is increased when compared with a case in which the difference is small.

15. The liquid ejecting apparatus according to claim 1, wherein the signal-producing-circuit controlling section is configured to control the signal producing circuit such that where a difference between the internal channel liquid temperature and the inflow liquid temperature is large, the number of pulses included in the vibration signal supplied instead of the non-ejection signal is increased when compared with a case in which the difference is small.

16. The liquid ejecting apparatus according to claim 1, wherein the signal-producing-circuit controlling section is configured to control the signal producing circuit such that where a difference between the internal channel liquid temperature and the inflow liquid temperature is large, a drive voltage of the vibration signal supplied instead of the non-ejection signal is increased when compared with a case in which the difference is small.

17. The liquid ejecting apparatus according to claim 1, wherein the controller includes a judging section configured to judge whether the increased heat amount where the vibration signal is supplied to each of the plurality of actuators instead of the non-ejection signal in the predetermined period exceeds the third heat amount or not, and wherein where the judging section has judged that the increased heat amount does not exceed the third heat amount, the signal-producing-circuit controlling section lengthens the recording period when compared with a case in which the judging section has judged that the increased heat amount is equal to or larger than the third heat amount.

18. The liquid ejecting apparatus according to claim 1, wherein the signal-producing-circuit controlling section controls the signal producing circuit such that where a difference between the internal channel liquid temperature and the inflow liquid temperature is large, the signal producing circuit lengthens the recording period when compared with a case in which the difference is small.

19. The liquid ejecting apparatus according to claim 1, wherein the signal-producing-circuit controlling section is configured to control the signal producing circuit such that where an amount of the liquid to be flowed into the liquid channel in the predetermined period is large, a total number of drivings of the actuators to which the vibration signal is supplied in the predetermined period is increased when compared with a case in which the amount of the liquid is small.

20. The liquid ejecting apparatus according to claim 1, wherein the signal-producing-circuit controlling section is configured to control the signal producing circuit such that where an amount of the liquid to be flowed into the liquid channel in the predetermined period is large, the number of pulses included in the vibration signal supplied instead of the non-ejection signal is increased when compared with a case in which the amount of the liquid is small.

21. The liquid ejecting apparatus according to claim 1, wherein the signal-producing-circuit controlling section is configured to control the signal producing circuit such that where an amount of the liquid to be flowed into the liquid channel in the predetermined period is large, a drive voltage of the vibration signal supplied instead of the non-ejection signal is increased when compared with a case in which the amount of the liquid is small.

22. The liquid ejecting apparatus according to claim 1, wherein the signal-producing-circuit controlling section is configured to control the signal producing circuit such that where an amount of the liquid to be flowed into the liquid channel in the predetermined period is large, the signal producing circuit lengthens the recording period when compared with a case in which the amount of the liquid is small.

23. The liquid ejecting apparatus according to claim 1, wherein the signal-producing-circuit controlling section is configured to control the signal producing circuit such that the signal producing circuit supplies the vibration signal, instead of the non-ejection signal supplied to each of the at least one actuator, to each of the at least one of the at least one actuator to which the non-ejection signal is supplied, in a period in the predetermined period which is other than a period in which recording is performed on a recording medium.

24. The liquid ejecting apparatus according to claim 1, wherein the signal-producing-circuit controlling section is configured to control the signal producing circuit such that the vibration signal is supplied instead of the non-ejection signal to each of at least one of the plurality of actuators to which the non-ejection signal is supplied over a predetermined number of the recording periods.

* * * * *